US012269706B2

(12) United States Patent
Thakare et al.

(10) Patent No.: US 12,269,706 B2
(45) Date of Patent: Apr. 8, 2025

(54) CABLE REEL

(71) Applicant: Amphenol Corporation, Wallingford, CT (US)

(72) Inventors: Rakesh Thakare, Cary, NC (US); Caichun Song, Changzhou (CN); Phillip S. Bowen, Chatham, VA (US); Marvin Bryant, Chatham, VA (US); Paul R. Boucher, Callands, VA (US); Barry Holt, Ottawa (CA)

(73) Assignee: TIMES FIBER COMMUNICATIONS, INC., Wallingford, CT (US)

( * ) Notice: Subject to any disclaimer, the term of this patent is extended or adjusted under 35 U.S.C. 154(b) by 18 days.

(21) Appl. No.: 17/345,962

(22) Filed: Jun. 11, 2021

(65) Prior Publication Data

US 2021/0300718 A1 Sep. 30, 2021

Related U.S. Application Data

(60) Continuation-in-part of application No. 16/804,577, filed on Feb. 28, 2020, which is a continuation of (Continued)

(51) Int. Cl.
*B65H 75/14* (2006.01)
*B65H 49/20* (2006.01)

(Continued)

(52) U.S. Cl.
CPC ..... *B65H 75/30* (2013.01); *B65H 49/205* (2013.01); *B65H 49/305* (2013.01);

(Continued)

(58) Field of Classification Search
CPC .. B65H 49/205; B65H 49/321; B65H 49/322; B65H 49/325; B65H 75/14; B65H 75/2245; B65H 75/2281; B65H 75/245
See application file for complete search history.

(56) References Cited

U.S. PATENT DOCUMENTS 1,418,706 A 6/1922 Hampton
1,990,135 A 2/1935 Takeo (Continued)

FOREIGN PATENT DOCUMENTS

DE 4001250 A1 7/1991
EP 0922003 B1 6/1999

(Continued)

OTHER PUBLICATIONS

Case 5:21-cv-00504-GTS-ML United States District Court for the Northern District of New York; Certificate of Good Standing; 1 page; Dated Jul. 9, 2021.

(Continued)

*Primary Examiner* — Michael R Mansen
*Assistant Examiner* — Katelynne R Burrell
(74) *Attorney, Agent, or Firm* — CANTOR COLBURN LLP

(57) ABSTRACT

A cable reel that includes a one-piece frame body, a flange separate from the frame body, and a hub member therebetween. The one-piece frame body includes an outer frame portion and an inner flange portion. The flange has an inner side that faces the inner side of the one-piece frame body. The hub member is located between the one-piece frame body and the flange along a central longitudinal axis of the cable reel. The hub member has a first end that rotatably couples to the inner flange portion of the one-piece frame body and a second end that couples to the flange. The hub member is configured to support a coil of cable and is sized to be received inside of an inner diameter of the coil of cable. The flange and the hub member rotate together with respect to the one-piece frame body.

26 Claims, 18 Drawing Sheets

Related U.S. Application Data application No. 15/833,091, filed on Dec. 6, 2017, now Pat. No. 10,589,957, which is a continuation of application No. 15/433,789, filed on Feb. 15, 2017, now Pat. No. 9,862,566, which is a division of application No. 14/634,007, filed on Feb. 27, 2015, now Pat. No. 9,695,008.

(51) Int. Cl.

| | |
|---|---|
| ***B65H 49/30*** | (2006.01) |
| ***B65H 49/32*** | (2006.01) |
| ***B65H 59/04*** | (2006.01) |
| ***B65H 75/22*** | (2006.01) |
| ***B65H 75/24*** | (2006.01) |
| ***B65H 75/30*** | (2006.01) |

(52) U.S. Cl.

CPC ..... *B65H 49/321* (2013.01); *B65H 49/322* (2013.01); *B65H 49/325* (2013.01); *B65H 59/04* (2013.01); *B65H 75/14* (2013.01); *B65H 75/2227* (2021.05); *B65H 75/2245* (2021.05); *B65H 75/2281* (2021.05); *B65H 75/245* (2013.01)

(56) References Cited

U.S. PATENT DOCUMENTS

| | | | |
|---|---|---|---|
| 2,033,578 | A | 3/1936 | Kittel |
| 2,268,547 | A | 1/1942 | Haines |
| 2,400,417 | A | 5/1946 | Hickey |
| 2,952,420 | A | 9/1960 | Von Hoorn |
| 2,965,331 | A | 12/1960 | Nagy |
| 3,693,784 | A | 9/1972 | Holmes |
| 3,696,697 | A | 10/1972 | Hoffman |
| 3,836,093 | A | 9/1974 | Mozina et al. |
| 4,650,073 | A | 3/1987 | Young |
| 4,667,896 | A | 5/1987 | Frey et al. |
| 5,139,210 | A | 8/1992 | Schaffer |
| 5,348,241 | A | 9/1994 | Huette |
| 5,464,171 | A | 11/1995 | Ripplinger |
| 5,524,850 | A | 6/1996 | Liao |
| 5,551,647 | A | 9/1996 | Browning |
| 5,704,479 | A | 1/1998 | Barnett et al. |
| 5,775,515 | A | 7/1998 | Chadwick |
| 5,775,621 | A | 7/1998 | Sauber |
| 5,810,283 | A | 9/1998 | Shea |
| 6,045,087 | A | 4/2000 | Vislocky et al. |
| 6,145,780 | A | 11/2000 | Fontana |
| 6,234,421 | B1 | 5/2001 | Cox et al. |
| 6,241,181 | B1 | 6/2001 | Campbell |
| 6,328,238 | B1 | 12/2001 | Chism |
| 6,352,215 | B1 | 3/2002 | Cash et al. |
| 6,523,777 | B2 | 2/2003 | Gaudio |
| 6,736,349 | B1 | 5/2004 | Boisdon et al. |
| 7,121,501 | B1 | 10/2006 | Lea |
| 7,140,598 | B2 | 11/2006 | Verakis et al. |
| 7,204,452 | B2 | 4/2007 | Wilkinson et al. |
| 7,891,601 | B2 | 2/2011 | Higashisaka et al. |
| 7,938,357 | B2 | 5/2011 | Johanson et al. |
| D641,161 | S | 7/2011 | Houston et al. |
| D641,162 | S | 7/2011 | Houston et al. |
| D641,163 | S | 7/2011 | Houston et al. |
| 8,016,222 | B2 | 9/2011 | Galgano et al. |
| 8,230,996 | B1 | 7/2012 | Cummings |
| 8,251,212 | B2 | 8/2012 | Dunlap |
| 8,366,126 | B2 | 2/2013 | Galgano et al. |
| 8,371,519 | B2 | 2/2013 | Mcmanus et al. |
| 8,387,909 | B2 | 3/2013 | Galgano et al. |
| 8,424,795 | B2 | 4/2013 | Galgano et al. |
| D686,907 | S | 7/2013 | Chastain et al. |
| 9,266,697 | B2 | 2/2016 | Houston et al. |
| 9,637,343 | B2 | 5/2017 | Allwood |
| 9,695,008 | B2 | 7/2017 | Thakare et al. |
| 9,796,556 | B1 | 10/2017 | Hill et al. |
| 9,862,566 | B2 | 1/2018 | Thakare et al. |
| 9,873,588 | B2 | 1/2018 | Thakare et al. |
| 9,908,737 | B2 | 3/2018 | Chastain et al. |
| 10,239,725 | B2 | 3/2019 | Chastain et al. |
| 10,589,957 | B2 | 3/2020 | Thakare et al. |
| 10,611,598 | B2 | 4/2020 | Thakare et al. |
| 10,689,223 | B2 | 6/2020 | Chastain et al. |
| 10,906,770 | B2 | 2/2021 | Thakare et al. |
| 10,906,771 | B2 | 2/2021 | Thakare et al. |
| 10,913,632 | B2 | 2/2021 | Thakare et al. |
| 10,941,016 | B2 | 3/2021 | Thakare et al. |
| 10,988,342 | B2 | 4/2021 | Thakare et al. |
| 10,988,343 | B2 | 4/2021 | Thakare et al. |
| 10,994,964 | B2 | 5/2021 | Thakare et al. |
| 11,001,471 | B2 | 5/2021 | Thakare et al. |
| 11,319,142 | B2 | 5/2022 | Crossett et al. |
| 2005/0035240 | A1 | 2/2005 | Weck et al. |
| 2006/0157366 | A1 | 7/2006 | Jamie |
| 2006/0231672 | A1 | 10/2006 | Eastwood et al. |
| 2007/0018031 | A1 | 1/2007 | Sycko |
| 2009/0008494 | A1 | 1/2009 | Maley |
| 2010/0078514 | A1 | 4/2010 | Thompson |
| 2010/0243784 | A1 | 9/2010 | Johanson et al. |
| 2010/0314484 | A1 | 12/2010 | Houston et al. |
| 2010/0320309 | A1 | 12/2010 | Galgano et al. |
| 2011/0240791 | A1 | 10/2011 | Lindley et al. |
| 2012/0091249 | A1 | 4/2012 | Crossett et al. |
| 2012/0153069 | A1 | 6/2012 | Allwood |
| 2012/0168554 | A1 | 7/2012 | Blunt et al. |
| 2012/0318939 | A1 | 12/2012 | Galgano |
| 2014/0312159 | A1 | 10/2014 | Troitzsch et al. |
| 2015/0312159 | A1 | 10/2015 | Ertugay et al. |
| 2015/0321876 | A1 | 11/2015 | Galindo Gonzalez |
| 2016/0347573 | A1 | 12/2016 | Runzel |
| 2020/0198924 | A1 | 6/2020 | Thakare et al. |

FOREIGN PATENT DOCUMENTS

| | | | |
|---|---|---|---|
| EP | 2017211 | A1 | 12/2009 |
| GB | 1031350 | A | 6/1966 |
| GB | 1417961 | A | 12/1975 |
| WO | 2007037173 | A1 | 4/2007 |

OTHER PUBLICATIONS

Case 5:21-cv-00504-GTS-ML United States District Court for the Northern District of New York; Declaration of B. Thomas Watson; 2 pages; Dated Sep. 13, 2021.

Case 5:21-cv-00504-GTS-ML United States District Court for the Northern District of New York; Declaration of Sponsor) Motions referred to Miroslav Lovric; 1 page; Dated Jul. 9, 2021.

Case 5:21-cv-00504-GTS-ML United States District Court for the Northern District of New York; Exhibit(s) A to Watson Declaration; 3 pages; Dated Sep. 13, 2021.

Case 5:21-cv-00504-GTS-ML United States District Court for the Northern District of New York;Response to Motion re 26 Motion to Dismiss filed by Amphenol Corporation.Motion returnable before Judge filed by PPC Broadband,Inc;2 pg;Dated Sep. 27, 2021.

Case 5:21-cv-00504-GTS-ML United States District Court for the Northern District of New York; Report on the Filing and Determination of an Action regarding patent and/or trademark U.S. Pat. No. 10,589,957. (sal) (Entered: Oct. 4, 2021); 3 pages.

Case 5:21-cv-00504-GTS-ML United States District Court for the Northern District of New York; Waiver of Service Returned Executed by PPC Broadband, Inc.; 1 page; May 13, 2021.

Case 5:21-cv-00504-GTS-ML United States District Court for the Northern District of New York; Summons Issued as to Amphenol Corporation; 2 pages; Dated Apr. 30, 2021.

Case 5:21-cv-00504-GTS-ML United States District Court for the Northern District of New York; Stipulation re 20 Amended Complaint for Extension of Time to Respond by Amphenol Corporation submitted to Judge Miroslav Lovric. (Butler, Brian); 1 page; Dated Aug. 6, 2021.

Case 5:21-cv-00504-GTS-ML United States District Court for the Northern District of New York; Stipulation of Dismissal (Joint) by

(56) References Cited

OTHER PUBLICATIONS

Amphenol Corporation submitted to Judge Glenn T. Suddaby. (McGuire, George) (Entered: Oct. 4, 2021); 2 pages.
Case 5:21-cv-00504-GTS-ML United States District Court for the Northern District of New York; Report on the Filing and Determination of an Action regarding patent and/or trademark U.S. Pat. No. 10,589,957; 1 page; Dated May 3, 2021.
Case 5:21-cv-00504-GTS-ML United States District Court for the Northern District of New York; Exhibit(s) B to Watson Declaration; 2 pgs; Dated Sep. 10, 2021.
Case 5:21-cv-00504-GTS-ML United States District Court for the Northern District of New York; Exhibit(s) C to Watson Declaration; 3 pages; Dated Sep. 13, 2021.
Case 5:21-cv-00504-GTS-ML United States District Court for the Northern District of New York; FRCP 7.1 Corporate Disclosure Statement by Amphenol Corporation; 3 pages; Dated Jul. 9, 2021.
Case 5:21-cv-00504-GTS-ML United States District Court for the Northern District of New York; FRCP 7.1 Corporate Disclosure Statement by PPC Broadband, Inc.; 1 page; Dated Apr. 30, 2021.
Case 5:21-cv-00504-GTS-ML United States District Court for the Northern District of New York; G.O. 25 Filing Order Issued; 15 pages; May 3, 2021.
Case 5:21-cv-00504-GTS-ML United States District Court for the Northern District of New York; Memorandum of Law) (McGuire, George); 8 pages; Sep. 13, 2021.
Case 5:21-cv-00504-GTS-ML United States District Court for the Northern District of New York; Motion for Limited Admission Pro Hac Vice of B. Thomas Watson: Certificate of Good Standing; 1 page; Dated Jul. 9, 2021.
Case 5:21-cv-00504-GTS-ML United States District Court for the Northern District of New York; Motion for Limited Admission Pro Hac Vice of B. Thomas Watson: Declaration of Sponsor; 1 page; Dated Jul. 9, 2021.
Case 5:21-cv-00504-GTS-ML United States District Court for the Northern District of New York; Motion for Limited Admission Pro Hac Vice of B. Thomas Watson: E-Filing Registration Form; 1 page; Dated Jul. 9, 2021.
Case 5:21-cv-00504-GTS-ML United States District Court for the Northern District of New York; Motion for Limited Admission Pro Hac Vice of B. Thomas Watson: Petition for Admission; 2 pages; Dated Jul. 9, 2021.
Case 5:21-cv-00504-GTS-ML United States District Court for the Northern District of New York; Motion for Limited Admission Pro Hac Vice of B. Thomas Watson; 2 pages; Dated Jul. 9, 2021.
Case 5:21-cv-00504-GTS-ML United States District Court for the Northern District of New York; Motion for Limited Admission Pro Hac Vice of Richard G. Frenkel: E-Filing Registration Form; 1 page; Dated Jul. 9, 2021.
Case 5:21-cv-00504-GTS-ML United States District Court for the Northern District of New York; Motion for Limited Admission Pro Hac Vice of Richard G. Frenkel: Petition for Admission; 3 pages; Dated Jul. 9, 2021.
Case 5:21-cv-00504-GTS-ML United States District Court for the Northern District of New York; Motion for Limited Admission Pro Hac Vice of Richard G. Frenkel; 2 pages; Dated Jul. 9, 2021.
Case 5:21-cv-00504-GTS-ML United States District Court for the Northern District of New York; Motion to Dismiss filed by Amphenol Corporation.; 3 pages; Jul. 9, 2021.
Case 5:21-cv-00504-GTS-ML United States District Court for the Northern District of New York; Motion to Dismiss filed by Amphenol Corporation: Declaration of B. Thomas Watson with attached Exhibits A & B; 7 pages; Dated Jul. 9, 2021.
Case 5:21-cv-00504-GTS-ML United States District Court for the Northern District of New York; Motion to Dismiss filed by Amphenol Corporation: Declaration of Rakesh Thakare) (McGuire, George); 2 pages; Dated Jul. 9, 2021.
Case 5:21-cv-00504-GTS-ML United States District Court for the Northern District of New York; Motion to Dismiss filed by Amphenol Corporation: Memorandum of Law in Support of Motion to Dismiss; 15 pages; Dated Jul. 9, 2021.
Case 5:21-cv-00504-GTS-ML United States District Court for the Northern District of New York; Motion to Dismiss filed by Amphenol Corporation; 3 pages; Dated Sep. 13, 2021.
Case 5:21-cv-00504-GTS-ML United States District Court for the Northern District of New York; Notice by PPC Broadband, Inc. deeming Defendant's 7 Motion to Dismiss as moot based upon the filing of Plaintiff's Amended Complaint; 2 pgs; Dated Jul. 29, 2021.
Case 5:21-cv-00504-GTS-ML United States District Court for the Northern District of New York; Notice of Admission Requirement ; Attorney B. Rashmi Borah; 1 page; Dated Jul. 12, 2021.
Case 5:21-cv-00504-GTS-ML United States District Court for the Northern District of New York; Notice of Admission Requirement ; Attorney Maximilian A. Grant; 1 page; Dated Jul. 12, 2021.
Case 5:21-cv-00504-GTS-ML United States District Court for the Northern District of New York; Notice of Appearance by Bornali Rashmi Borah on behalf of Amphenol Corporation; 2 pages; Jul. 20, 2021.
Case 5:21-cv-00504-GTS-ML United States District Court for the Northern District of New York; Notice of Appearance by Brian J. Butler on behalf of Amphenol Corporation; 1 page; Jul. 9, 2021.
Case 5:21-cv-00504-GTS-ML United States District Court for the Northern District of New York; Notice of Appearance by Maximilian Grant on behalf of Amphenol Corporation; 2 pages; Jul. 20, 2021.
Case 5:21-cv-00504-GTS-ML United States District Court for the Northern District of New York; Notice of Appearance by Richard G. Frenkel on behalf of Amphenol Corporation; 2 pages; Dated Jul. 21, 2021.
Case 5:21-cv-00504-GTS-ML United States District Court for the Northern District of New York; Order granting 24 Stipulation. Answer by Amphenol Corporation to Amended Complaint now due Sep. 13, 2021;1 page;Dated Aug. 10, 2021.
Ex. 1007 in Petition for Inter Partes Review of U.S. Pat. No. 11,001,471: Perfect Flex Broadband Coaxial Cable Packaging Options, http://www.ppc-online.com/Products/Coax_Cable/packaging-options.cfm, Apr. 14, 2014.
Petition for Inter Partes Review of U.S. Pat. No. 10,906,771; Joint Stipulation to Extend Due Dates 1-2; Dated: Feb. 22, 2023; 4 pages.
Petition for Inter Partes Review of U.S. Pat. No. 10,906,771; Patent Owner's Notice of Deposition of Cary Mullin; Dated: Feb. 22, 2023; 4 pages.
Petition for Inter Partes Review of U.S. Pat. No. 10,906,771; Patent Owner's Notice of Deposition of Dr. Charles A. Eldering; Dated Feb. 22, 2023; 4 pages.
Petition for Inter Partes Review of U.S. Pat. No. 10,906,771; Patent Owner's Notice of Deposition of Rebecca Firmani; Dated: Feb. 22, 2023; 4 pages.
Petition for Inter Partes Review of U.S. Pat. No. 10,906,771; Patent Owner's Updated Mandatory Notices Under 37 C.F.R § 42.8; Dated: Feb. 22, 2023; 5 pages.
Petition for Inter Partes Review of U.S. Pat. No. 10,941,016; Joint Stipulation to Extend Due Dates 1-2; Dated: Feb. 22, 2023; 3 pages.
Petition for Inter Partes Review of U.S. Pat. No. 10,941,016; Patent Owner's Notice of Deposition of Cary Mullin; Dated: Feb. 22, 2023; 3 pages.
Petition for Inter Partes Review of U.S. Pat. No. 10,941,016; Patent Owner's Notice of Deposition of Dr. Charles A. Eldering; Dated Feb. 22, 2023; 3 pages.
Petition for Inter Partes Review of U.S. Pat. No. 10,941,016; Patent Owner's Notice of Deposition of Rebecca Firmani; Dated: Feb. 22, 2023; 3 pages.
Petition for Inter Partes Review of U.S. Pat. No. 10,941,016; Patent Owner's Updated Mandatory Notices Under 37 C.F.R. § 42.8; Dated: Feb. 22, 2023; 4 pages.
Petition for Inter Partes Review of U.S. Pat. No. 10,941,016; Petitioner's Updated Mandatory Notices Under 37 C.F.R. § 42.8; Dated: Mar. 6, 2023; 4 pages.
Petition for Inter Partes Review of U.S. Pat. No. 10,941,016; Petitioner's Updated Power of Attorney and Designation of Lead and Back-Up Counsel; Dated: Mar. 6, 2023; 4 pages.
Petition for Inter Partes Review of U.S. Pat. No. 10,988,342; Joint Stipulation to Extend Due Dates 1-2; Dated: Feb. 22, 2023; 3 pages.

(56) References Cited

OTHER PUBLICATIONS

Petition for Inter Partes Review of U.S. Pat. No. 10,988,342; Patent Owner's Notice of Deposition of Cary Mullin; Dated: Feb. 22, 2023; 3 pages.
Petition for Inter Partes Review of U.S. Pat. No. 10,988,342; Patent Owner's Notice of Deposition of Dr. Charles A. Eldering; Dated Feb. 22, 2023; 3 pages.
Petition for Inter Partes Review of U.S. Pat. No. 10,988,342; Patent Owner's Notice of Deposition of Rebecca Firmani; Dated: Feb. 22, 2023; 3 pages.
Petition for Inter Partes Review of U.S. Pat. No. 10,988,342; Patent Owner's Updated Mandatory Notices Under 37 C.F.R. § 42.8; Dated: Feb. 22, 2023; 4 pages.
Petition for Inter Partes Review of U.S. Pat. No. 10,988,342; Petitioner's Updated Mandatory Notices Under 37 C.F.R. § 42.8; Dated: Mar. 6, 2023; 4 pages.
Petition for Inter Partes Review of U.S. Pat. No. 10,988,342; Petitioner's Updated Power of Attorney and Designation of Lead and Back-Up Counsel; Dated: Mar. 6, 2023; 4 pages.
Petition for Inter Partes Review of U.S. Pat. No. 11,001,471; Joint Stipulation to Extend Due Dates 1-2; Dated: Feb. 22, 2023; 3 pages.
Petition for Inter Partes Review of U.S. Pat. No. 11,001,471; Patent Owner's Notice of Deposition of Cary Mullin; Dated: Feb. 22, 2023; 3 pages.
Petition for Inter Partes Review of U.S. Pat. No. 11,001,471; Patent Owner's Notice of Deposition of Dr. Charles A. Eldering; Dated Feb. 22, 2023; 3 pages.
Petition for Inter Partes Review of U.S. Pat. No. 11,001,471; Patent Owner's Notice of Deposition of Rebecca Firmani; Dated: Feb. 22, 2023; 3 pages.
Petition for Inter Partes Review of U.S. Pat. No. 11,001,471; Patent Owner's Updated Mandatory Notices Under 37 C.F.R. § 42.8; Dated: Feb. 22, 2023; 4 pages.
Petition for Inter Partes Review of U.S. Pat. No. 11,001,471; Petitioner's Updated Mandatory Notices Under 37 C.F.R. § 42.8; Dated: Mar. 6, 2023; 4 pages.
Petition for Inter Partes Review of U.S. Pat. No. 11,001,471; Petitioner's Updated Power of Attorney and Designation of Lead and Back-Up Counsel; Dated: Mar. 6, 2023; 4 pages.
Case 1:21-cv-01823-GBW-MPT in United States District Court for District of Delaware;Disclosure Statement pursuant to Rule 7.1; Dated Dec. 27, 2021; 1 page.
Case 1:21-cv-01823-GBW-MPT in United States District Court for District of Delaware; Summons Issued with Magistrate Consent Notice attached as to PPC Broadband, Inc. on Dec. 27, 2021; 2 pages.
Case 1:21-cv-01823-GBW-MPT in the United States District Court for District of Delaware; Civil Cover Sheet; Dated Dec. 27, 2021; 1 page.
Case 1:21-cv-01823-GBW-MPT in the United States District Court for District of Delaware; Complaint for Patent Infringement filed with Jury Demand against PPC Broadband, Inc; Dated Dec. 27, 2021; 37 pages.
Case 1:21-cv-01823-GBW-MPT in the United States District Court for District of Delaware; Proposed Order —[Proposed] Scheduling Order by Times Fiber Communications, Inc.; Dated May 2, 2022; 14 pages.
Case 1:21-cv-01823-GBW-MPT in the United States District Court for District of Delaware; Exhibit F; Dated Sep. 10, 2021; 3 pages.
Case 1:21-cv-01823-GBW-MPT in the United States District Court for District of Delaware; Notice of Service of Defendant Objections &Responses to Plaintiff Interrogatories;Defendant Objections &Responses to Plaintiff Requests;May 20, 2022;2 pages.
Case 1:21-cv-01823-GBW-MPT in the United States District Court for District of Delaware; Vac Magistrate Non-Consent completed by the parties filed by Times Fiber Communications, Inc.. (Smith, Rodger)Entered: Apr. 6, 2022; 1 page.
Case 1:21-cv-01823-GBW-MPT in the United States District Court for District of Delaware; Letter to the Honorable Mary Pat Thynge; Dated May 2, 2022; 1 page.
Case 1:21-cv-01823-GBW-MPT in the United States District Court for District of Delaware; Motion for Pro Hac Vice Appearance of Attorney Denis Sullivan—filed by PPC Broadband, Inc.. (Kraman, Pilar) (Entered: Mar. 11, 2022); 4 pages.
Case 1:21-cv-01823-GBW-MPT in the United States District Court for District of Delaware; Motion for Pro Hac Vice Appearance of Attorney Denis Sullivan—filed by PPC Broadband, Inc.; Dated Mar. 23, 2022; 1 page.
Case 1:21-cv-01823-GBW-MPT in the United States District Court for District of Delaware; Motion for Pro Hac Vice Appearance of Attorney Douglas J. Nash, John D. Cook, and Naresh K. Kannan—filed by PPC Broadband, Inc; Entered Dec. 30, 2021; 7 pages.
Case 1:21-cv-01823-GBW-MPT in the United States District Court for District of Delaware; Motion for Pro Hac Vice Appearance of Attorney Gabrielle LaHatte—filed by Times Fiber Communications, Inc.. (Smith, Rodger) Entered: Apr. 6, 2022; 3 pages.
Case 1:21-cv-01823-GBW-MPT in the United States District Court for District of Delaware; Motion for Pro Hac Vice Appearance of Attorney Maximilian A. Grant, Richard G. Frenkel, Dale Chang, Richard A. Lowry, and Rebecca Lynne Neubauer; Dated Jan. 6, 2022; 8 pgs.
Case 1:21-cv-01823-GBW-MPT in the United States District Court for District of Delaware; Notice of Appearance of Genevieve M. Halpenny by PPC Broadband, Inc. (Kraman, Pilar) (Entered: Dec. 30, 2021); 3 pgs.
Case 1:21-cv-01823-GBW-MPT in the United States District Court for District of Delaware; Notice of Lodging by Times Fiber Communications, Inc. re 1 Complaint, Exhibits I and G (Smith, Rodger) (Entered: Dec. 28, 2021); 2 pages.
Case 1:21-cv-01823-GBW-MPT in the United States District Court for District of Delaware; Notice of Service of Defendant's First Supplemental Objections and Responses to Plaintiff's First Set of Interrogatories; Entered Jun. 28, 2022; 2 pages.
Case 1:21-cv-01823-GBW-MPT in the United States District Court for District of Delaware; Notice of Service of Defendant's Objections and Responses to Plaintiff's Second Set of Interrogatories (No. 12) filed by PPC Broadband, Inc; Entered Jun. 13, 2022; 2 pages.
Case 1:21-cv-01823-GBW-MPT in the United States District Court for District of Delaware; Notice of Service of Plaintiff Times Fiber Communication, Inc.'s ESI Initial Disclosures Pursuant to Delaware Default Standard for Discovery; Jun. 6, 2022; 3 pages.
Case 1:21-cv-01823-GBW-MPT in the United States District Court for District of Delaware; Notice of Service of Plaintiff Times Fiber Communication, Inc.'s Initial Disclosures—filed by Times Fiber Communications, Inc;Entered: May 20, 2022; 3 pages.
Case 1:21-cv-01823-GBW-MPT in the United States District Court for District of Delaware; Notice of Service of Plaintiff's First Amended ESI Initial Disclosures Pursuant to Delaware Default Standard for Discovery;Plaintiff's Identification;Jun. 8, 2022;3pg.
Case 1:21-cv-01823-GBW-MPT in the United States District Court for District of Delaware Notice of Service of Plaintiff's First Set of Interrogatories for Defendant; Plaintiff's First Set of Requests for Production Defendant; Apr. 13, 2022; 3 pages.
Case 1:21-cv-01823-GBW-MPT in the United States District Court for District of Delaware; Notice of Service of Plaintiff's Second Set of Interrogatories—filed by Times Fiber Communications, Inc;Entered May 11, 2022; 3 pg.
Case 1:21-cv-01823-GBW-MPT in the United States District Court for District of Delaware; Notice of Service of PPC's Disclosures Pursuant to Paragraph 3 of the Delaware Default Standard for Discovery filed by PPC Broadband, Inc; Jun. 6, 2022; 2 pages.
Case 1:21-cv-01823-GBW-MPT in the United States District Court for District of Delaware; Notice of Withdrawal of Counsel (Michelle Streifthau-Livizos) by Times Fiber Communications, Inc. (Streifthau-Livizos, Michelle) Entered: Apr. 1, 2022; 3 pages.
Case 1:21-cv-01823-GBW-MPT in the United States District Court for District of Delaware; Notice, Consent and Referral forms re: U.S. Magistrate Judge jurisdiction. (srs) (Entered: Dec. 28, 2021); Dated Dec. 27, 2021; 3 pages.
Case 1:21-cv-01823-GBW-MPT in the United States District Court for District of Delaware Proposed Order—[Proposed] Stipulated Protective Order—by Times Fiber Communications, Inc.. (Smith, Rodger) Entered: May 13, 2022; 26 pages.

(56) References Cited

OTHER PUBLICATIONS

Case 1:21-cv-01823-GBW-MPT in the United States District Court for District of Delaware; Report to Commissioner of Patents and Trademarks for Patent/Trademark U.S. Pat. Nos. 10,941,016;10,988,343;11,001,471;10,906,771;10,913,632; Dated Dec. 27, 2021; 1 page.
Case 1:21-cv-01823-GBW-MPT in the United States District Court for District of Delaware; Scheduling Order; Dated May 6, 2022; 14 pages.
Case 1:21-cv-01823-GBW-MPT in the United States District Court for District of Delaware; So Ordered, re 27 Stipulated Protective Order filed by Times Fiber Communications, Inc. Signed by Judge Mary Pat Thynge; Entered: May 13, 2022; 26 pages.
Case 1:21-cv-01823-GBW-MPT in the United States District Court for District of Delaware; Stipulation to Extend Time for Defendant to move against, answer, or otherwise respond to Plaintiff's Complaint—filed by PPC Broadband, Inc; Entered: Dec. 30, 2021; 2 pg.
Case 1:21-cv-01823-GBW-MPT in the United States District Court for District of Delaware; Stipulation to Stay Litigation by PPC Broadband, Inc. (Kraman, Pilar) Entered: Jul. 1, 2022; 2 pages.
Case 1:21-cv-01823-GBW-MPT in the United States District Court for District of Delaware; Summons Returned Executed by Times Fiber Communications, Inc.. PPC Broadband, Inc. served on Dec. 29, 2021, answer due Jan. 19, 2022.; 2 pgs.
Petition for Inter Partes Review of U.S. Pat. No. 10,589,957: Patent Owner's Exhibit List; Dated May 5, 2022.
Petition for Inter Partes Review of U.S. Pat. No. 10,589,957: Patent Owner's Mandatory Notices; Dated May 5, 2022.
Petition for Inter Partes Review of U.S. Pat. No. 10,589,957: Patent Owner's Power of Attorney; Dated May 5, 2022.
Petition for Inter Partes Review of U.S. Pat. No. 10,589,957: Petitioner's Exhibit List; Dated Apr. 21, 2022.
Petition for Inter Partes Review of U.S. Pat. No. 10,906,771: '771 Petitioner's Exhibit List; Dated Jun. 24, 2022.
Petition for Inter Partes Review of U.S. Pat. No. 10,906,771: '771 Petitioner's Power of Attorney and Designation of Lead and Back-up Counsel; Dated Jun. 21, 2022.
Petition for Inter Partes Review of U.S. Pat. No. 10,906,771: Patent Owner's Mandatory Notices; Dated Jul. 6, 2022.
Petition for Inter Partes Review of U.S. Pat. No. 10,906,771: Patent Owner's Power of Attorney; Dated Jul. 6, 2022.
Petition for Inter Partes Review of U.S. Pat. No. 10,913,632: '632 Petitioner's Exhibit List; Dated Apr. 18, 2022.
Petition for Inter Partes Review of U.S. Pat. No. 10,913,632: '632 Petitioner's Power of Attorney and Designation of Lead and Back-up Counsel; Dated Apr. 13, 2022.
Petition for Inter Partes Review of U.S. Pat. No. 10,913,632: Notice of Filing Date Accorded to Petition and Time for Filing Patent Owner Preliminary Response; Dated Apr. 29, 2022.
Petition for Inter Partes Review of U.S. Pat. No. 10,913,632: Patent Owner's Exhibit List; May 5, 2022.
Petition for Inter Partes Review of U.S. Pat. No. 10,913,632: Patent Owner's Mandatory Notices; Dated May 5, 2022.
Petition for Inter Partes Review of U.S. Pat. No. 10,913,632: Patent Owner's Power of Attorney; Dated May 5, 2022.
Petition for Inter Partes Review of U.S. Pat. No. 10,988,342: '342 Petitioner's Power of Attorney and Designation of Lead and Back-up Counsel; Dated May 13, 2022.
Petition for Inter Partes Review of U.S. Pat. No. 10,988,342: '342 Petitioner's Exhibit List; Dated May 27, 2022.
Petition for Inter Partes Review of U.S. Pat. No. 10,988,342: Notice of Filing Date Accorded to Petition; Dated Jun. 10, 2022.
Petition for Inter Partes Review of U.S. Pat. No. 10,988,342: Patent Owner's Mandatory Notices; Dated Jun. 7, 2022.
Petition for Inter Partes Review of U.S. Pat. No. 10,988,342: Patent Owner's Power of Attorney; Dated Jun. 7, 2022.
Petition for Inter Partes Review of U.S. Pat. No. 11,001,471: '471 Petitioner's Exhibit List; Dated May 18, 2022.
Petition for Inter Partes Review of U.S. Pat. No. 11,001,471: '471 Petitioner's Power of Attorney and Designation of Lead and Back-up Counsel; Dated May 13, 2022.
Petition for Inter Partes Review of U.S. Pat. No. 11,001,471: Notice of Filing Date Accorded to Petition; Dated Jun. 10, 2022.
Petition for Inter Partes Review of U.S. Pat. No. 11,001,471: Patent Owner's Mandatory Notices; Dated May 24, 2022.
Petition for Inter Partes Review of U.S. Pat. No. 11,001,471: Patent Owner's Power of Attorney; Dated May 24, 2022.
Corrected Petition for Inter Partes Review of U.S. Pat. No. 11,001,471; Dated Jul. 29, 2022.
Petition for Inter Partes Review of U.S. Pat. No. 10,906,771: Notice: Notice filing date accorded; Dated Jul. 13, 2022.
Petition for Inter Partes Review of U.S. Pat. No. 10,941,016: Patent Owner's Mandatory Notices; Dated Jul. 6, 2022.
Petition for Inter Partes Review of U.S. Pat. No. 10,941,016: Notice: Notice filing date accorded; Dated Jul. 13, 2022.
Petition for Inter Partes Review of U.S. Pat. No. 10,941,016: Petitioner's Power of Attorney and Designation of Lead and Back-Up Counsel; Dated Jun. 21, 2022.
Petition for Inter Partes Review of U.S. Pat. No. 10,941,016: Petitioner's Exhibit List; Dated Jun. 17, 202/.
Petition for Inter Partes Review of U.S. Pat. No. 10,941,016: Patent Owner's Power of Attorney; Dated Jun. 28, 2022.
Petition for Inter Partes Review of U.S. Pat. No. 10,589,957: '957 Power of Attorney and Designation of Lead and Back-up Counsel; Dated Apr. 20, 2022.
Petition for Inter Partes Review of U.S. Pat. No. 10,589,957: Notice of Filing Date Accorded to Petition; Dated May 4, 2022.
Petition for Inter Partes Review of U.S. Pat. No. 10,913,632: Patent Owner's Preliminary Response; Dated Jul. 29, 2022.
Petition for Inter Partes Review of U.S. Pat. No. 10,589,957: Patent Owner's Preliminary Response; Dated Aug. 4, 2022.
Case 5:21-cv-00504-GTS-ML United States District Court for the Northern District of New York; Amended Complaint against Amphenol Corporation; 7 pages; Dated Jul. 29, 2021.
Case 5:21-cv-00504-GTS-ML United States District Court for the Northern District of New York; Amended Complaint against Amphenol Corporation Exhibit B; 7 pages; Dated Jul. 10, 2020.
Case 5:21-cv-00504-GTS-ML United States District Court for the Northern District of New York; Amended Complaint against Amphenol Corporation Exhibit C; 2 pages; Dated Oct. 13, 2020.
Case 5:21-cv-00504-GTS-ML United States District Court for the Northern District of New York; Amended Complaint against Amphenol Corporation Exhibit D; 2 pages; Oct. 13, 2020.
Case 5:21-cv-00504-GTS-ML United States District Court for the Northern District of New York; Complaint With Jury Demand against Amphenol Corporation Exhibit B; 7 pages; Dated Jul. 10, 2020.
Case 5:21-cv-00504-GTS-ML United States District Court for the Northern District of New York; Complaint With Jury Demand against Amphenol Corporation Exhibit C; 1 page; Dated Apr. 30, 2021.
Case 5:21-cv-00504-GTS-ML United States District Court for the Northern District of New York; Complaint With Jury Demand against Amphenol Corporation; 5 pages; Dated Apr. 30, 2021.
Ex. 1029 in Petition for Inter Partes Review of U.S. Pat. No. 11,001,471: Printout of news article announcing SCTE Cable-Tec Expo 2014; Dated Sep. 23, 2014.
Ex. 1035 in Petition for Inter Partes Review of U.S. Pat. No. 11,001,471: YouTube video showing highlights of Cable-Tec Expo 2014 (available at https://www.youtube.com/watch?v=nzl3IFQT10M) (Appendix 11); Dated Sep. 30, 2014.
Ex. 1036 in Petition for Inter Partes Review of U.S. Pat. No. 11,001,471: Registration form for Cable-Tec Expo 2014 (Appendix 13); Dated Sep. 4, 2014.
Petition for Inter Partes Review of U.S. Pat. No. 10,941,016: Five Things We Learned from SCTE Cable-Tec Expo 2014; Dated Sep. 30, 2014.
Civil Action No. 5:21-cv-504 United States District Court Northern District of New York; Amended Complaint for Declaratory Judgment; Plaintiff PPC Broadband, Inc. ("PPC"), Amended Complaint

(56) References Cited

OTHER PUBLICATIONS for Declaratory Judgment of non-infringement against Defendant Amphenol Corporation ("Amphenol") Filed: Jul. 29, 2021; 7 pages.
Ex. 1002 in Petition for Inter Partes Review of U.S. Pat. No. 10,589,957: Declaration and CV of Dr. Charles A. Eldering.
Ex. 1002 in Petition for Inter Partes Review of U.S. Pat. No. 10,913,632: Declaration and CV of Dr. Charles A. Eldering.
Ex. 1002 in Petition for Inter Partes Review of U.S. Pat. No. 10,988,342: Declaration and CV of Dr. Charles A. Eldering.
Ex. 1002 in Petition for Inter Partes Review of U.S. Pat. No. 11,001,471: Declaration and CV of Dr. Charles A. Eldering.
Ex. 1002 in Petition for Inter Partes Review of U.S. Pat. No. 10,906,771: Declaration and CV of Dr. Charles A. Eldering.
Ex. 1008 in Petition for Inter Partes Review of U.S. Pat. No. 11,001,471: Complaint in *Times Fiber Communications, Inc.* v. *PPC Broadband, Inc.*, No. 1:21-cv-01823-UNA (D. Del. Dec. 27, 2021).
Ex. 1009 in Petition for Inter Partes Review of U.S. Pat. No. 10,589,957: Declaration of Ms. Cary Mullin.
Ex. 1009 in Petition for Inter Partes Review of U.S. Pat. No. 10,913,632: Declaration of Ms. Cary Mullin.
Ex. 1009 in Petition for Inter Partes Review of U.S. Pat. No. 10,988,342: Declaration of Ms. Cary Mullin.
Ex. 1009 in Petition for Inter Partes Review of U.S. Pat. No. 11,001,471: Declaration of Ms. Cary Mullin.
Ex. 1009 in Petition for Inter Partes Review of U.S. Pat. No. 10,906,771: Declaration of Ms. Cary Mullin.
Ex. 1038 in Petition for Inter Partes Review of U.S. Pat. No. 10,913,632: Declaration of Rebecca Firmani.
Ex. 1038 in Petition for Inter Partes Review of U.S. Pat. No. 10,988,342: Declaration of Rebecca Firmani.
Ex. 1038 in Petition for Inter Partes Review of U.S. Pat. No. 11,001,471: Declaration of Rebecca Firmani.
Ex. 1038 in Petition for Inter Partes Review of U.S. Pat. No. 10,906,771: Declaration of Rebecca Firmani.
Ex. 1039 in Petition for Inter Partes Review of U.S. Pat. No. 10,913,632: Declaration of Mark Banick.
Ex. 1039 in Petition for Inter Partes Review of U.S. Pat. No. 10,988,342: Declaration of Mark Banick.
Ex. 1039 in Petition for Inter Partes Review of U.S. Pat. No. 11,001,471: Declaration of Mark Banick.
Ex. 1039 in Petition for Inter Partes Review of U.S. Pat. No. 10,906,771: Declaration of Mark Banick.
Exhibit 2001 in Petition for Inter Partes Review of U.S. Pat. No. 10,589,957.
Exhibit 2001 in Petition for Inter Partes Review of U.S. Pat. No. 10,913,632.
Exhibit 2002 in Petition for Inter Partes Review of U.S. Pat. No. 10,589,957.
Exhibit 2002 in Petition for Inter Partes Review of U.S. Pat. No. 10,913,632.
Ex. 1002 in Petition for Inter Partes Review of U.S. Pat. No. 10,941,016: Declaration and CV of Dr. Charles A. Eldering.
Ex. 1038 in Petition for Inter Partes Review of U.S. Pat. No. 10,941,016: Declaration of Rebecca Firmani.
Ex. 1039 in Petition for Inter Partes Review of U.S. Pat. No. 10,941,016: Declaration of Mark Banick.
Ex. 1009 in Petition for Inter Partes Review of U.S. Pat. No. 10,941,016: Declaration of Ms. Cary Mullin.
Ex. 1006 in Petition for Inter Partes Review of U.S. Pat. No. 11,001,471: Published brochure of PPC's Perfect ToteTM 500 Eco reel tote bag ("Brochure") (Appendix 1).
Ex. 1010 in Petition for Inter Partes Review of U.S. Pat. No. 11,001,471: Photograph of PPC's booth at SCTE's Cable-Tec Expo (Sep. 2014) (Appendix 10).
Ex. 1015 in Petition for Inter Partes Review of U.S. Pat. No. 10,906,771: Merriam-Webster's Collegiate Dictionary 689 (Merriam-Webster, Inc. 11th ed 2007).
Ex. 1016 in Petition for Inter Partes Review of U.S. Pat. No. 11,001,471: Printout of news article dated Sep. 26, 2014, announcing PPC's exhibits at Cable-Tec Expo 2014 (Appendix 2).
Ex. 1018 in Petition for Inter Partes Review of U.S. Pat. No. 11,001,471: Printout of SCTE's webpage as of Mar. 13, 2014 (Appendix 3).
Ex. 1019 in Petition for Inter Partes Review of U.S. Pat. No. 11,001,471: Printout of SCTE Corporate Alliance Partner Program as of Jul. 2, 2014 (Appendix 4).
Ex. 1020 in Petition for Inter Partes Review of U.S. Pat. No. 11,001,471: Printout of MemberLINK webpage of SCTE as of Jul. 3, 2014 (Appendix 5).
Ex. 1021 in Petition for Inter Partes Review of U.S. Pat. No. 11,001,471: Printout of Cable-Tec Expo 2014 webpage as of Mar. 31, 2014.
Ex. 1022 in Petition for Inter Partes Review of U.S. Pat. No. 11,001,471: Printout showing the dates of exhibition at Cable-Tec Expo 2014 as of Sep. 22, 2014 (Appendix 6).
Ex. 1023 in Petition for Inter Partes Review of U.S. Pat. No. 11,001,471: Printout showing webpage for attendees at Cable-Tec Expo 2014 as of Sep. 22, 2014.
Ex. 1024 in Petition for Inter Partes Review of U.S. Pat. No. 11,001,471: Printout showing list of exhibitors at Cable-Tec Expo 2014 as of Sep. 20, 2014 (Appendix 9).
Ex. 1025 in Petition for Inter Partes Review of U.S. Pat. No. 11,001,471: Printout showing resources for first time attendees at Cable-Tec Expo 2014 as of Sep. 22, 2014 (Appendix 7).
Ex. 1026 in Petition for Inter Partes Review of U.S. Pat. No. 11,001,471: Printout of news article dated Sep. 26, 2014, showing number of attendees at Cable-Tec Expo 2014.
Ex. 1027 in Petition for Inter Partes Review of U.S. Pat. No. 11,001,471: Printout showing prices for registration at Cable-Tec Expo 2014 as of Sep. 22, 2014 (Appendix 8).
Ex. 1028 in Petition for Inter Partes Review of U.S. Pat. No. 11,001,471: Printout of news article dated Sep. 22, 2014, announcing Cisco's attendance at Cable-Tec Expo 2014.
Ex. 1029 in Petition for Inter Partes Review of U.S. Pat. No. 11,001,471: Printout of news article announcing SCTE Cable-Tec Expo 2014.
Ex. 1030 in Petition for Inter Partes Review of U.S. Pat. No. 11,001,471: Printout of news article dated Sep. 30, 2014, with highlights of Cable-Tec Expo 2014.
Ex. 1031 in Petition for Inter Partes Review of U.S. Pat. No. 11,001,471: Printout of news article dated Sep. 11, 2014, announcing Light Reading's attendance at Cable-Tec Expo 2014.
Ex. 1032 in Petition for Inter Partes Review of U.S. Pat. No. 11,001,471: Printout of news article dated Aug. 6, 2014, announcing Blonder Tongue's attendance at Cable-Tec Expo 2014.
Ex. 1033 in Petition for Inter Partes Review of U.S. Pat. No. 11,001,471: Printout of news article dated Aug. 7, 2014, announcing R. L. Drake's attendance at Cable-Tec Expo 2014.
Ex. 1034 in Petition for Inter Partes Review of U.S. Pat. No. 11,001,471: Printout of news article dated Sep. 16, 2014, announcing Applied Optoelectronics's attendance at Cable-Tec Expo 2014.
Ex. 1035 in Petition for Inter Partes Review of U.S. Pat. No. 11,001,471: YouTube video showing highlights of Cable-Tec Expo 2014 (available at https://www.youtube com/watch?v=nzl3IFQT10M) (Appendix 11).
Ex. 1036 in Petition for Inter Partes Review of U.S. Pat. No. 11,001,471: Registration form for Cable-Tec Expo 2014 (Appendix 13).
Ex. 1037 in Petition for Inter Partes Review of U.S. Pat. No. 11,001,471: E-mail dated Mar. 17, 2022, forwarding newsletter dated Sep. 25, 2014, announcing SCTE Cable-Tec Expo record attendance (Appendix 14).
Petition for Inter Partes Review of U.S. Pat. No. 10,941,016: Five Things We Learned from SCTE Cable-Tec Expo 2014.
Case 5:21-cv-00504-GTS-ML United States District Court for the Northern District of New York; Letter Regarding Exhibit E of Amended Complaint received,on file in Syracuse Clerk's office &not available for public viewing;3 pgs;Dated Jul. 29, 2021.
Case 5:21-cv-00504-GTS-ML United States District Court for the Northern District of New York; YouTube video showing CPJ Tech

(56) References Cited

OTHER PUBLICATIONS

Bag with Twist-Lock Reusable Reel; (available at https://www.youtube.com/watch?v=JJNttoCSjfU); Dated Feb. 7, 2020.
Case 5:21-cv-00504-GTS-ML United States District Court for the Northern District of New York; Exhibit E of Amended Complaint (Stills of Video 1 of 2); 59 pgs; Dated Oct. 13, 2020.
Case 5:21-cv-00504-GTS-ML United States District Court for the Northern District of New York; Exhibit E of Amended Complaint (Stills of Video 2 of 2); 32 pgs; Dated Oct. 13, 2020.
Axjo Cable Reel, "Attachment A"; 1 page.
Perfect Tote by PPC Broadband, Inc.; 2 pages.
Times Fiber Communications; Innovative Broadband Solutions; Tech Service Bag, pp. 1-2.
Ex. 1002 in Petition for Inter Partes Review of U.S. Pat. No. 10,589,957: Declaration and CV of Dr. Charles A. Eldering; Dated Apr. 20, 2022.
Ex. 1002 in Petition for Inter Partes Review of U.S. Pat. No. 10,913,632: Declaration and CV of Dr. Charles A. Eldering; Dated Apr. 18, 2021.
Ex. 1002 in Petition for Inter Partes Review of U.S. Pat. No. 10,988,342: Declaration and CV of Dr. Charles A. Eldering; Dated May 27, 2022.
Ex. 1002 in Petition for Inter Partes Review of U.S. Pat. No. 11,001,471: Declaration and CV of Dr. Charles A. Eldering; Dated May 18, 2022.
Fx. 1002 in Petition for Inter Partes Review of U.S. Pat. No. 10,906,771: Declaration and CV of Dr. Charles A. Eldering; Dated Jun. 23, 2022.
Ex. 1009 in Petition for Inter Partes Review of U.S. Pat. No. 10,589,957: Declaration of Ms. Cary Mullin; Dated Apr. 13, 2022.
Ex. 1009 in Petition for Inter Partes Review of U.S. Pat. No. 10,913,632: Declaration of Ms. Cary Mullin; Dated Apr. 13, 2022.
Ex. 1009 in Petition for Inter Partes Review of U.S. Pat. No. 10,988,342: Declaration of Ms. Cary Mullin; Dated May 13, 2022.
Ex. 1009 in Petition for Inter Partes Review of U.S. Pat. No. 11,001,471: Declaration of Ms. Cary Mullin; Dated May 13, 2022.
Ex. 1009 in Petition for Inter Partes Review of U.S. Pat. No. 10,906,771: Declaration of Ms. Cary Mullin; Dated May 16, 2022.
Ex. 1038 in Petition for Inter Partes Review of U.S. Pat. No. 10,913,632: Declaration of Rebecca Firmani; Dated Apr. 13, 2022.
Ex. 1038 in Petition for Inter Partes Review of U.S. Pat. No. 10,988,342: Declaration of Rebecca Firmani; Dated May 18, 2022.
Ex. 1038 in Petition for Inter Partes Review of U.S. Pat. No. 11,001,471: Declaration of Rebecca Firmani; Dated May 18, 2022.
Ex. 1038 in Petition for Inter Partes Review of U.S. Pat. No. 10,906,771: Declaration of Rebecca Firmani; Dated May 18, 2022.
Ex. 1039 in Petition for Inter Partes Review of U.S. Pat. No. 10,913,632: Declaration of Mark Banick; Dated Apr. 13, 2022.
Ex. 1039 in Petition for Inter Partes Review of U.S. Pat. No. 10,988,342: Declaration of Mark Banick; Dated May 13, 2022.
Ex. 1039 in Petition for Inter Partes Review of U.S. Pat. No. 11,001,471: Declaration of Mark Banick; Dated May 13, 2022.
Ex. 1039 in Petition for Inter Partes Review of U.S. Pat. No. 10,906,771: Declaration of Mark Banick; Dated May 18, 2022.
Exhibit 2001 in Petition for Inter Partes Review of U.S. Pat. No. 10,589,957; Dated Dec. 23, 2021.
Exhibit 2001 in Petition for Inter Partes Review of U.S. Pat. No. 10,913,632; Dated Dec. 23, 2021.
Exhibit 2002 in Petition for Inter Partes Review of U.S. Pat. No. 10,589,957; Dated Jul. 22, 2022.
Exhibit 2002 in Petition for Inter Partes Review of U.S. Pat. No. 10,913,632; Dated Jul. 28, 2022.
Ex. 1002 in Petition for Inter Partes Review of U.S. Pat. No. 10,941,016: Declaration and CV of Dr. Charles A. Eldering; Dated Jun. 15, 2022.
Ex. 1038 in Petition for Inter Partes Review of U.S. Pat. No. 10,941,016: Declaration of Rebecca Firmani; Dated May 18, 2022.
Ex. 1039 in Petition for Inter Partes Review of U.S. Pat. No. 10,941,016: Declaration of Mark Banick; Dated May 16, 2022.
Ex. 1009 in Petition for Inter Partes Review of U.S. Pat. No. 10,941,016: Declaration of Ms. Cary Mullin; Dated May 16, 2022.
Case 1:21-cv-01823-GBW-MPT in the United States District Court for District of Delaware; Complaint for Patent Infringement filed with Jury Demand against PPG Broadband, Inc; 37 pages; Dated Dec. 27, 2021.
Case 1:21-cv-01823-GBW-MPT in the United States District Court for District of Delaware; YouTube video showing CPJ Tech Bag with Twist-Lock Reusable Reel; (available at https://www.youtube.com/watch?v=JJNttoCSjfU); Dated Feb. 7, 2020.
Case 1:21-cv-01823-GBW-MPT in the United States District Court for District of Delaware; Exhibit G of Complaint (Stills of Video 1 of 2); 58 pgs; Dated Oct. 13, 2020.
Case 1:21-cv-01823-GBW-MPT in the United States District Court for District of Delaware; Exhibit I of Complaint (Stills of Video 2 of 2); 31 pgs; Dated Oct. 13, 2020.
Ex. 1006 in Petition for Inter Partes Review of U.S. Pat. No. 11,001,471: Published brochure of PPC's Perfect ToteTM 500 Eco reel tote bag ("Brochure") (Appendix 1); Dated Sep. 25, 2014.
Case 1:21-cv-01823-GBW-MPT in the United States District Court for District of Delaware; Answer to 1 Complaint, with Jury Demand by PPC Broadband, Inc.; Dated Feb. 28, 2022; 23 pages.
Case 1:21-cv-01823-GBW-MPT in the United States District Court for District of Delaware; Exhibit H; DatedOct. 13, 2020; 2 pages.
Case 1:21-cv-01823-GBW-MPT in the United States District Court for District of Delaware; Exhibit J; Dated Oct. 13, 2020; 2 pages.
Case 1:21-cv-01823-GBW-MPT in the United States District Court for District of Delaware; Disclosure Statement pursuant to Rule 7.1: identifying Corporate Parent Belden Inc. for PPC Broadband, Inc. filed by PPC Broadband, Inc; Entered: Feb. 28, 2022; 2 pgs.
Petition for Inter Partes Review of U.S. Pat. No. 10,913,632: Request for Refund of Post-Institution Fees for Inter Partes Review of U.S. Pat. No. 10,913,632; Dated Dec. 1, 2022; 4 pages.
Petition for Inter Partes Review of U.S. Pat. No. 10,913,632: Decision Denying Institution of Inter Partes Review Due to Disclaimer of All Challenged Claims 35 U.S.C. § 314; 37 C.F.R. § 42.107(e); Entered Oct. 24, 2022; 6 pages.
Petition for Inter Partes Review of U.S. Pat. No. 10,913,632: Notice of Refund; Entered Dec. 14, 2022; 2 pages.
Petition for Inter Partes Review of U.S. Pat. No. 11,001,471; Scheduling Order 37 C.F.R. §42.5; Dated Dec. 8, 2022; 13 pages.
Petition for Inter Partes Review of U.S. Pat. No. 11,001,471; Patent Owner'S Objections to Petitioner's Evidence; Dated Dec. 21, 2022; 5 pages.
Petition for Inter Partes Review of U.S. Pat. No. 11,001,471; Decision Granting Institution of Inter Partes Review 35 U.S.C. § 314; Dated Dec. 7, 2022; 28 pages.
Petition for Inter Partes Review of U.S. Pat. No. 10,988,342; Scheduling Order 37 C.F.R. § 42.5; Dated Dec. 8, 2022; 13 pages.
Petition for Inter Partes Review of U.S. Pat. No. 10,988,342; Patent Owner's Objections to Petitioner's Evidence; Dated Dec. 21, 2022; 5 pages.
Petition for Inter Partes Review of U.S. Pat. No. 10,988,342; Decision Granting Institution of Inter Partes Review 35 U.S.C. § 314(a); Entered Dec. 7, 2022; 25 pages.
Petition for Inter Partes Review of U.S. Pat. No. 10,941,016; Decision Granting Institution of Inter Partes Review 35 U.S.C. § 314; Dated Dec. 19, 2022; 19 pages.
Petition for Inter Partes Review of U.S. Pat. No. 10,941,016; Scheduling Order; Dated Dec. 19, 2022; 19 pages.
Petition for Inter Partes Review of U.S. Pat. No. 10,941,016; Patent Owner's Objections to Petitioner's Evidence; Dated Jan. 4, 2023; 5 pages.
Petition for Inter Partes Review of U.S. Pat. No. 10,589,957; Request for Refund of Post-Institution Fees for Inter Partes Review of U.S. Pat. No. 10,589,957; Dated Dec. 1, 2022; 4 pages.
Petition for Inter Partes Review of U.S. Pat. No. 10,589,957; Decision Denying Institution of Inter Partes Review Due to Disclaimer of All Challenged Claims 35 U.S.C. § 314; 37 C.F.R. § 42.107(e); Dated Oct. 24, 2022 4 pages.
Petition for Inter Partes Review of U.S. Pat. No. 10,589,957; Notice of Refund; Dated Dec. 14, 2022; 2 pages.

(56) References Cited

OTHER PUBLICATIONS

Petition for Inter Partes Review of U.S. Pat. No. 10,906,771; Decision Granting Institution of Inter Partes Review 35 U.S.C. § 314; Dated Dec. 21, 2022; 17 pages.
Petition for Inter Partes Review of U.S. Pat. No. 10,906,771; Scheduling Order; Dated Dec. 21, 2022; 13 pages.
Petition for Inter Partes Review of U.S. Pat. No. 10,906,771; Patent Owner's Objections to Petitioner's Evidence; Dated Jan. 4, 2023; 6 pages.
Petition for Inter Partes Review of U.S. Pat. No. 10,589,957: Patent Owner's Exhibit List.
Petition for Inter Partes Review of U.S. Pat. No. 10,589,957: Patent Owner's Mandatory Notices.
Petition for Inter Partes Review of U.S. Pat. No. 10,589,957: Patent Owner's Power of Attorney.
Petition for Inter Partes Review of U.S. Pat. No. 10,589,957: Petitioner's Exhibit List.
Petition for Inter Partes Review of U.S. Pat. No. 10,589,957; Filed Apr. 21, 2022; 102 pages.
Petition for Inter Partes Review of U.S. Pat. No. 10,906,771: '771 Petitioner's Exhibit List.
Petition for Inter Partes Review of U.S. Pat. No. 10,906,771: '771 Petitioner's Power of Attorney and Designation of Lead and Back-up Counsel.
Petition for Inter Partes Review of U.S. Pat. No. 10,906,771: Patent Owner's Mandatory Notices.
Petition for Inter Partes Review of U.S. Pat. No. 10,906,771: Patent Owner's Power of Attorney.
Petition for Inter Partes Review of U.S. Pat. No. 10,913,632: '632 Petitioner's Exhibit List.
Petition for Inter Partes Review of U.S. Pat. No. 10,913,632: '632 Petitioner's Power of Attorney and Designation of Lead and Back-up Counsel.
Petition for Inter Partes Review of U.S. Pat. No. 10,913,632: Notice of Filing Date Accorded to Petition and Time for Filing Patent Owner Preliminary Response.
Petition for Inter Partes Review of U.S. Pat. No. 10,913,632: Patent Owner's Exhibit List.
Petition for Inter Partes Review of U.S. Pat. No. 10,913,632: Patent Owner's Mandatory Notices.
Petition for Inter Partes Review of U.S. Pat. No. 10,913,632: Patent Owner's Power of Attorney.
Petition for Inter Partes Review of U.S. Pat. No. 10,913,632; Filed Apr. 18, 2022; 110 pages.
Petition for Inter Partes Review of U.S. Pat. No. 10,988,342: '342 Petitioner's Power of Attorney and Designation of Lead and Back-up Counsel.
Petition for Inter Partes Review of U.S. Pat. No. 10,988,342: '342 Petitioner's Exhibit List.
Petition for Inter Partes Review of U.S. Pat. No. 10,988,342: Notice of Filing Date Accorded to Petition.
Petition for Inter Partes Review of U.S. Pat. No. 10,988,342: Patent Owner's Mandatory Notices.
Petition for Inter Partes Review of U.S. Pat. No. 10,988,342: Patent Owner's Power of Attorney.
Petition for Inter Partes Review of U.S. Pat. No. 10,988,342; Filed May 27, 2022; 107 pages.
Petition for Inter Partes Review of U.S. Pat. No. 11,001,471 Filed May 18, 2022; 98 pages.
Petition for Inter Partes Review of U.S. Pat. No. 11,001,471: '471 Petitioner's Exhibit List.
Petition for Inter Partes Review of U.S. Pat. No. 11,001,471: '471 Petitioner's Power of Attorney and Designation of Lead and Back-up Counsel.
Petition for Inter Partes Review of U.S. Pat. No. 11,001,471: Notice of Filing Date Accorded to Petition.
Petition for Inter Partes Review of U.S. Pat. No. 11,001,471: Patent Owner's Mandatory Notices.
Petition for Inter Partes Review of U.S. Pat. No. 11,001,471: Patent Owner's Power of Attorney.
Petition for Inter Partes Review of U.S. Pat. No. 10,906,771; Filed Jun. 24, 2022; 108 pages.
Corrected Petition for Inter Partes Review of U.S. Pat. No. 11,001,471.
Petition for Inter Partes Review of U.S. Pat. No. 10,906,771: Notice: Notice filing date accorded.
Petition for Inter Partes Review of U.S. Pat. No. 10,941,016; Filed Jun. 17, 2022; 118 pages.
Petition for Inter Partes Review of U.S. Pat. No. 10,941,016: Patent Owner's Mandatory Notices.
Petition for Inter Partes Review of U.S. Pat. No. 10,941,016: Notice: Notice filing date accorded.
Petition for Inter Partes Review of U.S. Pat. No. 10,941,016: Petitioner's Power of Attorney and Designation of Lead and Back-Up Counsel.
Petition for Inter Partes Review of U.S. Pat. No. 10,941,016: Petitioner's Exhibit List.
Petition for Inter Partes Review of U.S. Pat. No. 10,941,016: Patent Owner's Power of Attorney.
Petition for Inter Partes Review of U.S. Pat. No. 10,589,957: '957 Power of Attorney and Designation of Lead and Back-up Counsel.
Petition for Inter Partes Review of U.S. Pat. No. 10,589,957: Notice of Filing Date Accorded to Petition.
Petition for Inter Partes Review of U.S. Pat. No. 10,913,632: Patent Owner's Preliminary Response.
Petition for Inter Partes Review of U.S. Pat. No. 10,589,957: Patent Owner's Preliminary Response.
YouTube video SCTE-ISBE Cable-Tec Expo video presentation, Zero Waste Challenges: The Lifecycle of Coax Cable (Oct. 12-15, 2020); (https://www.youtube.com/watch?v=m1UTia_ft1A).
U.S. Appl. No. 18/174,272, filed Feb. 24, 2023; Non-Final Office Action dated May 8, 2023; 127 pages.
Petition for Inter Partes Review of U.S. Pat. No. 11,001,471: Petitioner's Updated Exhibit List; Date: Jun. 21, 2023; 7 pages.
Petition for Inter Partes Review of U.S. Pat. No. 11,001,471: Petitioner's Updated Exhibit List; Date: Jun. 27, 2023; 7 pages.
Petition for Inter Partes Review of U.S. Pat. No. 11,001,471: Petitioner's Request for Oral Hearing; Date: Aug. 9, 2023; 5 pages.
Petition for Inter Partes Review of U.S. Pat. No. 11,001,471: USPTO Assignment Record for Blunt; Date Recorded: Mar. 18, 2011; 2 pages.
Ex. 1054 in Petition for Inter Partes Review of U.S. Pat. No. 10,988,342: Prosecution History of U.S. Pat. No. 10,994,964; 183 pages.
Ex. 1055 in Petition for Inter Partes Review of U.S. Pat. No. 10,988,342: Prosecution History of U.S. Pat. No. 10,988,343; 181 pages.
Exhibit 2001 for IPR2022-00946 (U.S. Pat. No. 10,988,342), IPR2022-00947 (U.S. Pat. No. 11,001,471), IPR2022-01087 (U.S. Pat. No. 10,941,016), andIPR2022-01088 (U.S. Pat. No. 10,906,771); Deposition of Charles A. Eldering; Date: Mar. 23, 2023; 128 pages.
Exhibit 2002 for IPR2022-00946 (U.S. Pat. No. 10,988,342), IPR2022-00947 (U.S. Pat. No. 11,001,471), IPR2022-01087 (U.S. Pat. No. 10,941,016), andIPR2022-01088 (U.S. Pat. No. 10,906,771); Deposition of Rebecca Firmani; Date: Mar. 8, 2023; 45 pages.
Exhibit 2003 for IPR2022-00946 (U.S. Pat. No. 10,988,342), IPR2022-00947 (U.S. Pat. No. 11,001,471), IPR2022-01087 (U.S. Pat. No. 10,941,016), andIPR2022-01088 (U.S. Pat. No. 10,906,771); Deposition of Cary Mullin; Date: Mar. 8, 2023; 67 pages.
Exhibit 2004 for Petition for Inter Partes Review of U.S. Pat. No. 10,941,016; Declaration of Rakesh Thakare; Date: Mar. 24, 2023; 5 pages.
Exhibit 2004 for Petition for Inter Partes Review of U.S. Pat. No. 10,988,342; Declaration of Rakesh Thakare; Date: Mar. 24, 2023; 5 pages.
Exhibit 2004 for Petition for Inter Partes Review of U.S. Pat. No. 11,001,471: Declaration of Rakesh Thakare; Date: Mar. 24, 2023; 5 pages.
Exhibit 2004 Petition for Inter Partes Review of U.S. Pat. No. 10,906,771; Declaration of Rakesh Thakare; Date: Mar. 24, 2023; 5 pages.
Exhibit 2007 for Petition for Inter Partes Review of U.S. Pat. No. 10,941,016; Exhibit H filed Dec. 27, 2021 in Case 1:21-cv-01823-UNA; Date Entered: Mar. 29, 2023; 2 pages.

(56) References Cited

OTHER PUBLICATIONS

Exhibit 2007 for Petition for Inter Partes Review of U.S. Pat. No. 10,988,342; Exhibit H filed Dec. 27, 2021 in Case 1:21-cv-01823-UNA; Date Entered: Mar. 29, 2023; 2 pages.
Exhibit 2007 for Petition for Inter Partes Review of U.S. Pat. No. 11,001,471: Exhibit H filed Dec. 27, 2021 in Case 1:21-cv-01823-UNA; Date Entered: Mar. 29, 2023; 2 pages.
Exhibit 2007 Petition for Inter Partes REVExhibit 2007 Petition for Inter Partes Review of U.S. Pat. No. 10,906,771; Exhibit H filed Dec. 27, 2021 in Case 1:21-cv-01823-UNA; Date Entered: Mar. 29, 2023; 2 pages Iew of U.S. Pat. No. 10,906,771.
Exhibit 2008 for Petition for Inter Partes Review of U.S. Pat. No. 10,941,016; Date Entered: Jan. 21, 2022; 3 pages.
Exhibit 2008 for Petition for Inter Partes Review of U.S. Pat. No. 10,988,342; Date: Jan. 21, 2022; 3 pages.
Exhibit 2008 for Petition for Inter Partes Review of U.S. Pat. No. 11,001,471; Date: Jan. 21, 2022; 3 pages.
Exhibit 2008 Petition for Inter Partes Review of U.S. Pat. No. 10,906,771; Date Entered: Jan. 21, 2022; 3 pages.
Exhibit 2009 for Petition for Inter Partes Review of U.S. Pat. No. 10,941,016; Charter Communications; "Charter Announces Fourth Quarter and Full Year 2015 Results"; Date: Feb. 4, 2016; 24 pages.
Exhibit 2009 for Petition for Inter Partes Review of U.S. Pat. No. 10,988,342; Charter Communications; "Charter Announces Fourth Quarter and Full Year 2015 Results"; Date: Feb. 4, 2016; 24 pages.
Exhibit 2009 for Petition for Inter Partes Review of U.S. Pat. No. 11,001,471; Charter Communications; "Charter Announces Fourth Quarter and Full Year 2015 Results"; Date: Feb. 4, 2016; 24 pages.
Exhibit 2009 Petition for Inter Partes Review of U.S. Pat. No. 10,906,771; Charter Communications; "Charter Announces Fourth Quarter and Full Year 2015 Results"; Date: Feb. 4, 2016; 24 pages.
Exhibit 2016 Part 1 for Petition for Inter Partes Review of U.S. Pat. No. 10,941,016; Date: Oct. 12, 2020; 6 pages.
Exhibit 2016 Part 1 for Petition for Inter Partes Review of U.S. Pat. No. 10,988,342; Date: Oct. 12, 2020; 6 pages.
Exhibit 2016 Part 1 for Petition for Inter Partes Review of U.S. Pat. No. 11,001,471; Date: Oct. 12, 2020; 6 pages.
Exhibit 2016 Part 1 Petition for Inter Partes Review of U.S. Pat. No. 10,906,771: Date: Oct. 12, 2020; 6 pages.
Exhibit 2016 Part 2 for Petition for Inter Partes Review of U.S. Pat. No. 10,941,016; Date: Oct. 12, 2020; 6 pages.
Exhibit 2016 Part 2 for Petition for Inter Partes Review of U.S. Pat. No. 10,988,342; Date: Oct. 12, 2020; 6 pages.
Exhibit 2016 Part 2 for Petition for Inter Partes Review of U.S. Pat. No. 11,001,471; Date: Oct. 12, 2020; 6 pages.
Exhibit 2016 Part 2 Petition for Inter Partes Review of U.S. Pat. No. 10,906,771: Date: Oct. 12, 2020; 6 pages.
Patent Owner's Consolidated Demonstratives for IPR2022-00946 (U.S. Pat. No. 10,988,342), IPR2022-00947 (U.S. Pat. No. 11,001,471), IPR2022-01087 (U.S. Pat. No. 10,941,016), & IPR2022-01088 (U.S. Pat. No. 10,906,771); Date: Sep. 20, 2023; 47 pages.
LEAP Practitioner Verification Form and Request for Oral Hearing Participation for Xirui Zhang for IPR2022-00946 (U.S. Pat. No. 10,988,342), IPR2022-00947 (U.S. Pat. No. 11,001,471), IPR2022-01087 (U.S. Pat. No. 10,941,016), and IPR2022-01088 (U.S. Pat. No. 10,906,771); Date: Sep. 13, 2023; 2 pages.
Inter Partes Review Certificate for U.S. Pat. No. 11,001,471: Date: Mar. 4, 2024; 2 pages.
Inter Partes Review Certificate for U.S. Pat. No. 10,988,342: Date: Feb. 29, 2024; 2 pages.
Inter Partes Review Certificate for U.S. Pat. No. 10,941,016: Date: Mar. 18, 2024; 2 pages.
Exhibit 2019 Petition for Inter Partes Review of U.S. Pat. No. 10,906,771; Declaration of Sarah Propst in Response To Petitioner's Objections To Patent Owner's Exhibits; Date: Apr. 6, 2023; 4 pages.
Exhibit 2019 Petition for Inter Partes Review of U.S. Pat. No. 10,941,016; Declaration of Sarah Propst in Response To Petitioner's Objections To Patent Owner's Exhibits; Date: Apr. 6, 2023; 4 pages.
Exhibit 2019 Petition for Inter Partes Review of U.S. Pat. No. 10,988,342: Declaration of Sarah Propst in Response To Petitioner's Objections To Patent Owner's Exhibits; Date: Apr. 6, 2023; 4 pages.
Exhibit 2019 Petition for Inter Partes Review of U.S. Pat. No. 11,001,471: Declaration of Sarah Propst in Response To Petitioner's Objections To Patent Owner's Exhibits; Date: Apr. 6, 2023; 4 pages.
Exhibit 3001 Petition for Inter Partes Review of U.S. Pat. No. 10,988,342: USPTO Assignment Record for Blunt; Date Recorded: Mar. 18, 2011; 2 pages.
Granting the Parties' Requests for Oral Argument for IPR2022-00946 (U.S. Pat. No. 10,988,342), IPR2022-00947 (U.S. Pat. No. 11,001,471), IPR2022-01087 (U.S. Pat. No. 10,941,016), & IPR2022-01088 (U.S. Pat. No. 10,906,771); Date: Aug. 23, 2023; 11 pages.
Inter Partes Review Certificate for U.S. Pat. No. 10,906,771: Date: Mar. 8, 2024; 3 pages.
Petition for Inter Partes Review of U.S. Pat. No. 10,906,771: Patent Owner's Updated Mandatory Notices Under 37 C.F.R. § 42.8; Dated Apr. 7, 2023; 5 pages.
Petition for Inter Partes Review of U.S. Pat. No. 10,906,771; Corrected Patent Owner's Request for Oral Argument; Date: Aug. 9, 2023; 5 pages.
Petition for Inter Partes Review of U.S. Pat. No. 10,906,771; Joint Stipulation To Extend Due Date 3; Date: Jul. 11, 2023; 4 pages.
Petition for Inter Partes Review of U.S. Pat. No. 10,906,771; Patent Owner's Updated Mandatory Notices; Date: Sep. 21, 2023; 5 pages.
Petition for Inter Partes Review of U.S. Pat. No. 10,906,771; Patent Owner's Opposition To Motion To Exclude; Date: Sep. 6, 2023; 14 pages.
Petition for Inter Partes Review of U.S. Pat. No. 10,906,771; Patent Owner's Sur-Reply; Date: Aug. 21, 2023; 31 pages.
Petition for Inter Partes Review of U.S. Pat. No. 10,906,771; Patent Owner's Unopposed Motion To Expunge Confidential Information From the Record; Date: Mar. 12, 2024; 13 pages.
Petition for Inter Partes Review of U.S. Pat. No. 10,906,771; Petitioner's Motion To Exclude; Date: Aug. 30, 2023; 6 pages.
Petition for Inter Partes Review of U.S. Pat. No. 10,906,771; Petitioner's Motion To Seal; Date: Jun. 21, 2023; 3 pages.
Petition for Inter Partes Review of U.S. Pat. No. 10,906,771; Petitioner's Motion To Seal; Date: Sep. 13, 2023; 3 pages.
Petition for Inter Partes Review of U.S. Pat. No. 10,906,771; Petitioner's Public Reply To Patent Owner's Response; Date: Jun. 21, 2023; 38 pages.
Petition for Inter Partes Review of U.S. Pat. No. 10,906,771; Petitioner's Reply To Patent Owner's Opposition To Motion To Exclude; Date: Sep. 13, 2023; 4 pages.
Petition for Inter Partes Review of U.S. Pat. No. 10,906,771; Petitioner's Updated Exhibit List; Date: Jun. 21, 2023; 7 pages.
Petition for Inter Partes Review of U.S. Pat. No. 10,906,771; Petitioner's Updated Exhibit List; Date: Jun. 27, 2023; 7 pages.
Petition for Inter Partes Review of U.S. Pat. No. 10,906,771; Petitioner's Request for Oral Hearing; Date: Aug. 9, 2023; 5 pages.
Petition for Inter Partes Review of U.S. Pat. No. 10,906,771; USPTO Assignment Record for Blunt; Date Recorded: Mar. 18, 2011; 2 pages.
Petition for Inter Partes Review of U.S. Pat. No. 10,941,016; Corrected Patent Owner's Request for Oral Argument; Date: Aug. 9, 2023; 5 pages.
Petition for Inter Partes Review of U.S. Pat. No. 10,941,016; Joint Stipulation To Extend Due Date 3; Date: Jul. 11, 2023; 4 pages.
Petition for Inter Partes Review of U.S. Pat. No. 10,941,016; Patent Owner's Updated Mandatory Notices; Date: Apr. 7, 2023; 5 pages.
Petition for Inter Partes Review of U.S. Pat. No. 10,941,016; Patent Owner's Updated Mandatory Notices; Date: Sep. 21, 2023; 5 pages.
Petition for Inter Partes Review of U.S. Pat. No. 10,941,016; Patent Owner's Opposition To Motion To Exclude; Date: Sep. 6, 2023; 14 pages.
Petition for Inter Partes Review of U.S. Pat. No. 10,941,016; Patent Owner's Sur-Reply; Date: Aug. 21, 2023; 31 pages.
Petition for Inter Partes Review of U.S. Pat. No. 10,941,016; Patent Owner's Unopposed Motion To Expunge Confidential Information From the Record; Date: Mar. 12, 2024; 13 pages.
Petition for Inter Partes Review of U.S. Pat. No. 10,941,016; Petitioner's Motion To Exclude; Date: Aug. 30, 2023; 6 pages.

(56) References Cited

OTHER PUBLICATIONS

Petition for Inter Partes Review of U.S. Pat. No. 10,941,016; Petitioner's Motion To Seal; Date: Jun. 21, 2023; 3 pages.
Petition for Inter Partes Review of U.S. Pat. No. 10,941,016; Petitioner's Motion To Seal; Date: Sep. 13, 2023; 3 pages.
Petition for Inter Partes Review of U.S. Pat. No. 10,941,016; Petitioner's Public Reply To Patent Owner's Response; Date: Jun. 21, 2023; 38 pages.
Petition for Inter Partes Review of U.S. Pat. No. 10,941,016; Petitioner's Reply To Patent Owner's Opposition To Motion To Exclude; Date: Sep. 13, 2023; 4 pages.
Petition for Inter Partes Review of U.S. Pat. No. 10,941,016; Petitioner's Updated Exhibit List; Date: Jun. 21, 2023; 7 pages.
Petition for Inter Partes Review of U.S. Pat. No. 10,941,016; Petitioner's Updated Exhibit List; Date: Jun. 27, 2023; 7 pages.
Petition for Inter Partes Review of U.S. Pat. No. 10,941,016; Petitioner's Request for Oral Hearing; Date: Aug. 9, 2023; 5 pages.
Petition for Inter Partes Review of U.S. Pat. No. 10,941,016; USPTO Assignment Record for Blunt; Date Recorded: Mar. 18, 2011; 2 pages.
Petition for Inter Partes Review of U.S. Pat. No. 10,988,342: Corrected Patent Owner's Request for Oral Argument; Date: Aug. 9, 2023; 5 pages.
Petition for Inter Partes Review of U.S. Pat. No. 10,988,342: Joint Stipulation To Extend Due Date 3; Date: Jul. 11, 2023; 4 pages.
Petition for Inter Partes Review of U.S. Pat. No. 10,988,342: Patent Owner's Updated Mandatory Notices; Date: Apr. 7, 2023; 5 pages.
Petition for Inter Partes Review of U.S. Pat. No. 10,988,342: Patent Owner's Updated Mandatory Notices; Date: Sep. 21, 2023; 5 pages.
Petition for Inter Partes Review of U.S. Pat. No. 10,988,342: Patent Owner's Opposition To Motion To Exclude; Date: Sep. 6, 2023; 14 pages.
Petition for Inter Partes Review of U.S. Pat. No. 10,988,342: Patent Owner's Sur-Reply; Date: Aug. 21, 2023; 31 pages.
Petition for Inter Partes Review of U.S. Pat. No. 10,988,342: Patent Owner's Unopposed Motion To Expunge Confidential Information From the Record; Date: Mar. 12, 2024; 13 pages.
Petition for Inter Partes Review of U.S. Pat. No. 10,988,342: Petitioner's Motion To Exclude; Date: Aug. 30, 2023; 6 pages.
Petition for Inter Partes Review of U.S. Pat. No. 10,988,342: Petitioner's Motion To Seal; Date: Jun. 21, 2023; 3 pages.
Petition for Inter Partes Review of U.S. Pat. No. 10,988,342: Petitioner's Motion To Seal; Date: Sep. 13, 2023; 3 pages.
Petition for Inter Partes Review of U.S. Pat. No. 10,988,342: Petitioner's Public Reply To Patent Owner's Response; Date: Jun. 21, 2023; 38 pages.
Petition for Inter Partes Review of U.S. Pat. No. 10,988,342: Petitioner's Reply To Patent Owner's Opposition To Motion To Exclude; Date: Sep. 13, 2023; 4 pages.
Petition for Inter Partes Review of U.S. Pat. No. 10,988,342: Petitioner's Updated Exhibit List; Date: Jun. 21, 2023; 7 pages.
Petition for Inter Partes Review of U.S. Pat. No. 10,988,342: Petitioner's Updated Exhibit List; Date: Jun. 27, 2023; 7 pages.
Petition for Inter Partes Review of U.S. Pat. No. 10,988,342: Petitioner's Request for Oral Hearing; Date: Aug. 9, 2023; 5 pages.
Petition for Inter Partes Review of U.S. Pat. No. 11,001,471: Corrected Patent Owner's Request for Oral Argument; Date: Aug. 9, 2023; 5 pages.
Petition for Inter Partes Review of U.S. Pat. No. 11,001,471: Joint Stipulation To Extend Due Date 3; Date: Jul. 11, 2023; 4 pages.
Petition for Inter Partes Review of U.S. Pat. No. 11,001,471: Patent Owner's Updated Mandatory Notices; Date: Apr. 7, 2023; 5 pages.
Petition for Inter Partes Review of U.S. Pat. No. 11,001,471: Patent Owner's Updated Mandatory Notices; Date: Sep. 21, 2023; 5 pages.
Petition for Inter Partes Review of U.S. Pat. No. 11,001,471: Patent Owner's Opposition To Motion To Exclude; Date: Sep. 6, 2023; 14 pages.
Petition for Inter Partes Review of U.S. Pat. No. 11,001,471: Patent Owner's Sur-Reply; Date: Aug. 21, 2023; 31 pages.
Petition for Inter Partes Review of U.S. Pat. No. 11,001,471: Patent Owner's Unopposed Motion To Expunge Confidential Information From the Record; Date: Mar. 12, 2024; 13 pages.
Petition for Inter Partes Review of U.S. Pat. No. 11,001,471: Petitioner's Motion To Exclude; Date: Aug. 30, 2023; 6 pages.
Petition for Inter Partes Review of U.S. Pat. No. 11,001,471: Petitioner's Motion To Seal; Date: Jun. 21, 2023; 3 pages.
Petition for Inter Partes Review of U.S. Pat. No. 11,001,471: Petitioner's Motion To Seal; Date: Sep. 13, 2023; 3 pages.
Petition for Inter Partes Review of U.S. Pat. No. 11,001,471: Petitioner's Public Reply To Patent Owner's Response; Date: Jun. 21, 2023; 37 pages.
Petition for Inter Partes Review of U.S. Pat. No. 11,001,471: Petitioner's Reply To Patent Owner's Opposition To Motion To Exclude; Date: Sep. 13, 2023; 4 pages.
Exhibit 2005 for Petition for Inter Partes Review of U.S. Pat. No. 10,941,016; Amphenol Broadband Solutions Tech Service Bag II; Date Entered: Mar. 29, 2023; 2 pages.
Exhibit 2005 for Petition for Inter Partes Review of U.S. Pat. No. 11,001,471: Amphenol Broadband Solutions Tech Service Bag II; Date Entered: Mar. 29, 2023; 2 pages.
Exhibit 2014 for Petition for Inter Partes Review of U.S. Pat. No. 10,941,016; PPC; NexReel™ Solution Perfect Link®; Date Entered: Mar. 29, 2023; 1 page.
ORDER Granting-In-Part & Denying-in-Part Patent Owner's Motions to Expunge Confidential Information from Record for IPR2022-00946, IPR2022-00947, IPR2022-01087, & IPR2022-01088; Date: Apr. 9, 2024; 6 pages.
Petition for Inter Partes Review of U.S. Pat. No. 10,906,771; Patent Owner's Updated Mandatory Notices Under 37 C.F.R. § 42.8; Dated: Mar. 29, 2024; 5 pages.
Petition for Inter Partes Review of U.S. Pat. No. 10,941,016; Patent Owner's Updated Mandatory Notices Under 37 C.F.R. § 42.8; Dated: Mar. 29, 2024; 5 pages.
Petition for Inter Partes Review of U.S. Pat. No. 10,988,342; Patent Owner's Updated Mandatory Notices Under 37 C.F.R. § 42.8; Dated: Mar. 29, 2024; 5 pages.
Petition for Inter Partes Review of U.S. Pat. No. 11,001,471; Patent Owner's Updated Mandatory Notices Under 37 C.F.R. § 42.8; Dated: Mar. 29, 2024; 5 pages.
Ex. 1003 in Petition for Inter Partes Review of U.S. Pat. No. 10,589,957: Prosecution History of the '957 patent.
Ex. 1003 in Petition for Inter Partes Review of U.S. Pat. No. 10,913,632: Prosecution History of the '632 patent.
Ex. 1003 in Petition for Inter Partes Review of U.S. Pat. No. 10,941,016: Prosecution History of the '016 patent.
Ex. 1003 in Petition for Inter Partes Review of U.S. Pat. No. 10,988,342: Prosecution History of the '342 patent.
Ex. 1003 in Petition for Inter Partes Review of U.S. Pat. No. 11,001,471: Prosecution History of the '471 patent.
Ex. 1003 in Petition for Inter Partes Review of U.S. Pat. No. 10,906,771: Prosecution History of the '771 patent.

CABLE REEL

RELATED APPLICATIONS

This application is a continuation-in-part of application Ser. No. 16/804,577, filed Feb. 28, 2020, which is a continuation of application Ser. No. 15/833,091, filed Dec. 6, 2017, now U.S. Pat. No. 10,589,957, which is a continuation of application Ser. No. 15/433,789, filed Feb. 15, 2017, now U.S. Pat. No. 9,862,566, which is a divisional of U.S. application Ser. No. 14/634,007, entitled Cable Reel, filed on Feb. 27, 2015, now U.S. Pat. No. 9,695,008, the content of each of which is relied upon and incorporated herein by reference in their entirety.

BACKGROUND

Cable installers are commonly required to carry cable to installation locations. The installers usually use some type of shoulder bag or other types of packing solutions with an opening for paying out the cable. These cables are often wound on a reel to form a cable coil and packaged in a box or bag for payout during installations. The installer may, however, payout too much cable if the installer pulls too hard on the cable.

SUMMARY

Accordingly, the present disclosure may provide a cable reel that has first and second opposing flanges. The first flange has a first hub portion and the second flange has a second hub portion. The first and second hub portions are axially aligned and configured to mate with one another to support cable, such as a cable coil. The first hub portion includes an elongated wall that extends from the first flange. The elongated wall is sized to support the cable. The elongated wall defines an inner area that is configured to accept the second hub portion. The elongated wall includes a plurality of flexible segments. The second hub portion includes a truncated wall that is receivable in the inner area of the first hub portion. The truncated wall includes a tapered outer surface for engaging and expanding the plurality of flexible segments.

The present disclosure may also provide a cable reel that includes at least one support frame that has an outwardly extending braking gear member. The outwardly extending gear member is located off-center on the frame. A first flange has a central opening and a first hub portion that surrounds the central opening. The central opening has an internal braking gear member that engages the outwardly extending gear member of the frame, thereby rotatably coupling the at least one support frame and the first flange. A second flange opposes the first flange and has a second hub portion. The first and second hub portions are configured to mate with one another to support cable. The engagement of the gear members provides a friction for cable payoff.

The present disclosure may further provide a method of installing the cable, such as a cable coil, on a cable reel that includes the steps of providing a cable reel that includes first and second opposing flanges, the first flange having a first hub portion and the second flange having a second hub portion, the first hub portion being longer than the second hub portion, and the first hub portion having a plurality of flexible segments; placing a cable coil over the first hub portion and on the first flange so that the first hub portion extends through the cable coil; and inserting the second hub portion inside of the first hub portion, thereby expanding the flexible segments so that the flexible segments engage the cable coil.

The present disclosure may yet further provide a method of installing cable on a cable reel that comprises the steps of providing a cable reel that includes first and second opposing flanges where the first flange has a first hub portion and the second flange having a second hub portion and the first hub portion has one or more flexible segments; placing a cable coil over the first hub portion and on the first flange so that the first hub portion substantially extends through an inner diameter of the cable coil; and expanding the one or more flexible segments by inserting the second hub portion inside of the first hub portion so that the one or more flexible segments engage the cable coil.

The present disclosure may also further provide a method of installing cable on a cable reel, that comprises the steps of providing a cable reel that includes first and second frames that rotatably support first and second opposing flanges, respectively, where the first flange has a first hub portion and the second flange has a second hub portion and the first hub portion has an elongated wall that defines a receiving area for a truncated wall of the second hub portion; placing a cable coil over the first hub portion and on the first flange so that the first hub portion substantially extends through an inner diameter of the cable coil; and inserting the truncated wall of the second hub portion inside of the receiving area of the first hub portion, thereby retaining the cable coil between the first and second frames such that the cable coil rotates with respect to the first and second frames, thereby allowing payout of the cable of the cable coil.

The present disclosure relates to a method of installing a coil of cable in a bag, that comprises the steps of: placing a coil of cable on a first hub of a first flange of the cable reel; placing a second flange of the cable reel, that is separable from the first flange, opposite from the first flange to hold the coil of cable on the first hub of the first flange; positioning the first flange on or next to a first support frame received in the bag; and placing the second flange on or next to a second support frame received in the bag. The second support frame is positioned in the bag such that the first flange, the coil of cable and the second flange are located between the first support frame and the second support frame.

In some examples, the method further comprises the step of engaging the first and second flanges after placing the second flange opposite from the first flange, thereby holding the coil of cable between the first and second flanges; the step of engaging the first and second flanges includes snapping the first and second flanges together; the step of engaging the first and second flanges includes engaging a second hub of the second flange with the first hub of the first flange; and/or the first hub of the first flange is an elongated wall.

In other examples, the method further comprises the step of disengaging the first flange from the second flange; further comprises the step of disengaging the first flange from the second flange after opening the bag; and/or further comprises the steps of rotatably coupling the first flange and the first frame and rotatably coupling the second flange and the second frame.

The present disclosure relates to a method of installing a coil of cable in a bag, that comprises the steps of: placing a coil of cable on a first hub of a first flange of the cable reel; placing a second flange of the cable reel opposite from the first flange to hold the coil of cable on the first hub of the first flange; positioning the first flange on or next to a first support frame located in the bag; and placing the second flange on or next to a second support frame located in the bag, wherein the second support frame is positionable in the bag such that the first flange, the coil of cable and the second flange are located between the first support frame and the second support frame. The step of placing the coil of cable on the first hub of the first flange occurs before the step of positioning the first flange on the first support frame.

In certain examples, the step of placing the second flange of the cable reel opposite from the first flange to hold the coil of cable on the first hub of the first flange includes engaging a second hub of the second flange with the first hub; and/or the method further comprises the step of disengaging the second hub from the first hub after opening the bag.

The present disclosure relates to a method of installing a coil of cable in a bag, the bag having a cover for opening the bag, a base opposite the cover, and sides extending between the cover and the base, the comprises the steps of: placing a coil of cable on a first hub of a first flange of the cable reel; placing a second flange of the cable reel, that is separable from the first flange, opposite from the first flange to hold the coil of cable on the first hub of the first flange; positioning the first flange on or next to a first support frame received in the bag, the first support frame being on an inner surface the base of the bag; and placing the second flange on or next to a second support frame received in the bag, the second support frame being on an inner surface of the cover of the bag. When the cover of the bag is closed, the first flange, the coil of cable and the second flange are located between the first support frame and the second support frame inside the bag.

In some examples, the method further comprises the step of engaging the first and second flanges after placing the second flange opposite from the first flange, thereby holding the coil of cable between the first and second flanges; the step of engaging the first and second flanges includes engaging a second hub of the second flange with the first hub of the first flange; the method further comprises the step of disengaging the first flange from the second flange; the method further comprises the step of opening the bag by opening the cover and the step disengaging the first flange from the second flange occurs after opening the bag; and/or the method further comprises the steps of rotatably coupling the first flange and the first frame and rotatably coupling the second flange and the second frame.

In other examples, the coil of cable is prepacked with a plastic wrap prior to the step of placing the coil of cable on the first hub of the first flange; and/or the method further comprises the step of dispensing the cable through a payout slot in the bag.

The present disclosure also relates to a cable reel that comprises a one-piece frame body, a flange separate from the one-piece frame body, and a hub member. The one-piece frame body includes an outer frame portion and an inner flange portion. The inner flange portion has an outer side and an inner side. The flange has an outer side and an inner side. The inner side of the flange faces the inner side of the one-piece frame body. The hub member is located between the one-piece frame body and the flange along a central longitudinal axis of the cable reel. The hub member has a first end and a second end. The first end rotatably couples to the inner flange portion of the one-piece frame body and the second end couples to the flange. The hub member is configured to support a coil of cable and is sized to be received inside of an inner diameter of the coil of cable. The flange and the hub member rotate together with respect to the one-piece frame body.

In certain examples, the one-piece frame body has a coupler extending from the inner frame portion for rotatably coupling to the first end of the hub member; the coupler has a flexible distal end for snapping into a transverse wall of the hub member; the hub member has one or more engagement features configured to frictionally engage the inner diameter of the coil of cable; the one or more engagement features is one or more flexible tabs disposed in a main wall of the hub member; the hub member has one or more latching features configured to releasably latch to the flange; and/or the one or more latching features is one or more elongated snapping arms.

In other examples, the hub member is one-piece or the flange is one-piece; the outer frame portion of the one-piece frame body surrounds the inner flange portion; the outer frame portion has a substantially square shape and the inner flange portion has a substantially disc shape; an end face of the first end of the hub member is adjacent to the inner side of the one-piece frame body; and/or the flange has a central opening for rotational engagement with a frame.

The present disclosure may also relate to a cable reel apparatus that comprises a coil of cable, a bag, and a cable reel. The coil of cable has an outer diameter and an inner diameter. The bag has a base, a cover, and a payout opening for dispensing cable of the coil of cable. The cable reel comprises a one-piece frame body that is configured to be received inside of the base of the bag. The one-piece frame body has an outer frame portion and an inner flange portion. A flange separate from the one-piece frame body and is configured to be positioned facing the one-piece frame body. The flange is sized to accommodate the outer diameter of the coil of cable. A hub member is located between the one-piece frame body and the flange along a central longitudinal axis of the cable reel. The hub member has a first end and a second end. The first end releasably and rotatable couples to the inner flange portion of the one-piece frame body and the second end releasably and non-rotatably couples to the flange. The hub member is configured to support the coil of cable and is sized to be received inside of the inner diameter of the coil of cable. The flange and the hub member rotate together with respect to the one-piece frame body.

In some examples, the coil of cable is prepackaged without a reel, the hub member includes a main wall and a transverse wall therein, the main wall being sized to fit within the inner diameter of the coil of cable; the main wall includes one or more engagement features for frictionally engaging the inner diameter of the coil of cable; the transverse wall includes an opening for rotatably coupling with a coupler of the one-piece frame body, the coupler extending from the inner flange portion of the one-piece frame body; the hub member includes one or more latching features for releasably and non-rotatably coupling to the flange; there is no structure between the first end of the hub member and the inner side of the one-piece frame body; and/or the flange includes an opening configured to rotatably couple with a frame on an inside surface of the cover of the bag.

The present disclose may yet also relate to a kit of separate components for assembly of a cable reel apparatus that comprises a bag, a one-piece frame body, a flange, and a hub member. The bag has a base and a cover, wherein the bag is sized to hold a coil of cable. The one-piece frame body includes an outer frame portion and an inner flange portion. The outer frame portion has a geometry for placement on an inside surface of the base of the bag and the inner flange portion having a coupler. A flange sized to accommodate an outer diameter of the coil of cable. A hub member that has a first end and a second end. The first end of the hub member is configured to releasably and rotatably couple to the coupler of the one-piece frame body. The second end of the hub member is configured to releasably and non-rotatably couple with the flange.

In certain examples of the kit, the outer frame portion of the one-piece frame body has a substantially square shape that surrounds the inner flange portion, the inner flange portion has a substantially disc shape, and the coupler extends from a center of the inner flange portion; the hub member includes a main wall and a transverse wall therein, the main wall has one or more flexible tabs at the second end, and the transverse wall has an opening sized to rotatably couple with the coupler of the one-piece frame body; the hub member includes one or more elongated latching arms configured to releasably and non-rotatably engage the flange; the cover of the bag includes a frame on an inside surface thereof, the flange of the cable reel is configured to rotatably coupling with the frame of the cover; and/or the flange has a substantially disc shape and a central opening for engaging the frame of the cover.

This summary is not intended to identify essential features of the claimed subject matter, nor is it intended for use in determining the scope of the claimed subject matter. It is to be understood that both the foregoing general description and the following detailed description are exemplary and are intended to provide an overview or framework to understand the nature and character of the disclosure.

BRIEF DESCRIPTION OF THE FIGURES

The accompanying drawings are incorporated in and constitute a part of this specification. It is to be understood that the drawings illustrate only some examples of the disclosure and other examples or combinations of various examples that are not specifically illustrated in the figures may still fall within the scope of this disclosure. Examples will now be described with additional detail through the use of the drawings, in which.

DETAILED DESCRIPTION

Referring to FIGS. 1-3, 4A, 4B, 5A, 5B, and 6-8, the present disclosure relates to a cable reel 100 that may be carried in a conventional shoulder bag or satchel, a cardboard or plastic box, and the like 101, with an opening 103 for easy payout of cable supported on the cable reel. The cable reel 100 according to one example of the present disclosure is designed to provide easy installation of cable C, such as a cable coil, on the reel 100 and also prevents overpayout of the cable. Because the cable reel 100 is designed to be carried by an installer, it is preferable that the components of the cable reel 100 be formed of lighter weight materials, such as plastic. Some exemplary plastic materials include polyethylene, polypropylene, ABS or other polymer products.

Figure 1:
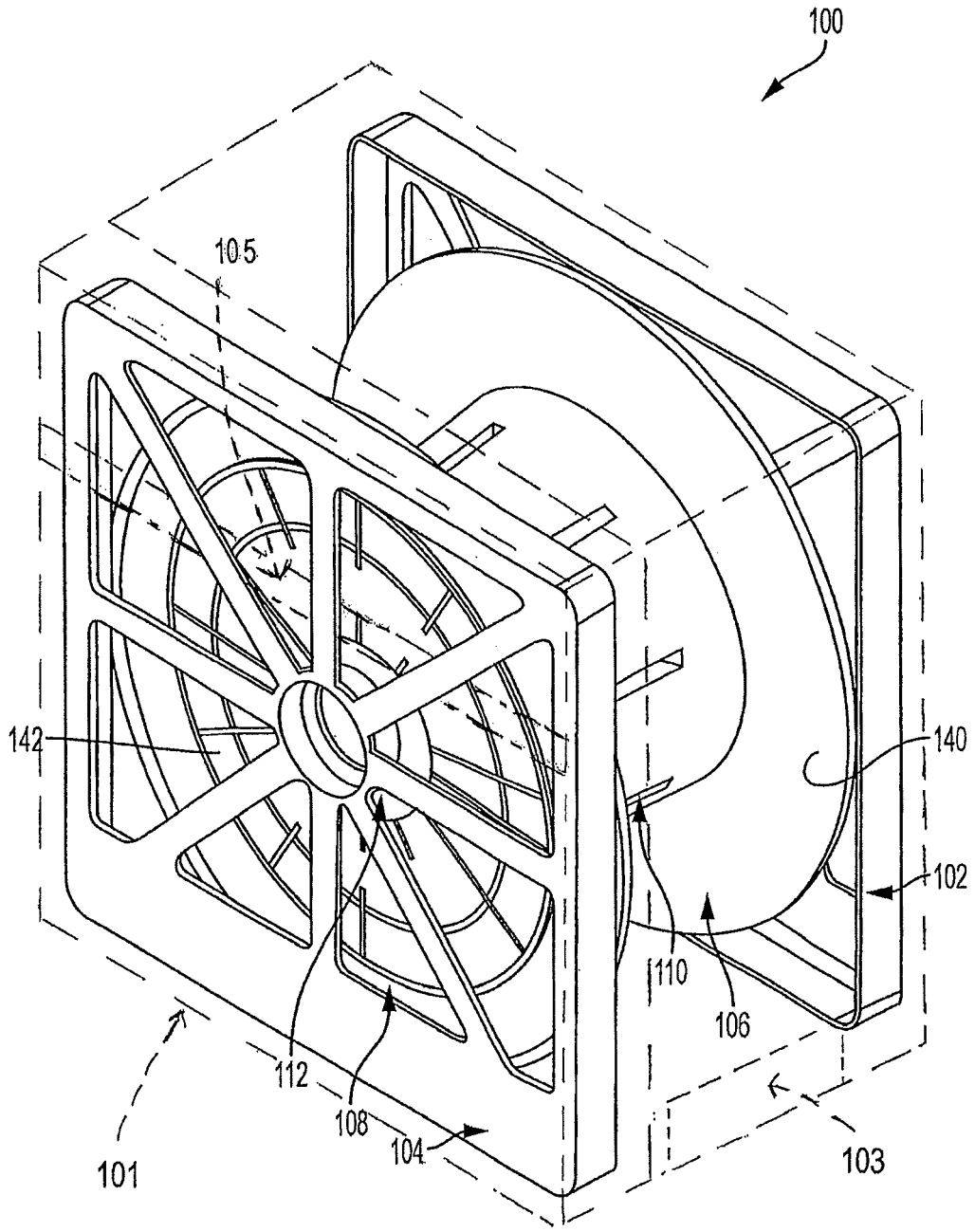
FIG. 1 is a perspective view of a cable reel in accordance with an example of the present disclosure, shown without a supporting bag or box.

As seen in FIG. 1, the cable reel 100 generally includes opposing support frames 102 and 104 that rotatably support first and second flanges 106 and 108 with a hub member 110 therebetween on which the cable is held. A braking mechanism 112 is preferably provided on the reel 100 between the support frames 102 and 104 of the flanges 106 and 108 to limit overpayout of the cable. The cable reel 100 may be inserted into and supported by the payout bag or box wherein the support frames 102 and 104 are attached, preferably removably attached, to the cover and base, respectively, of the bag.

Figure 2:
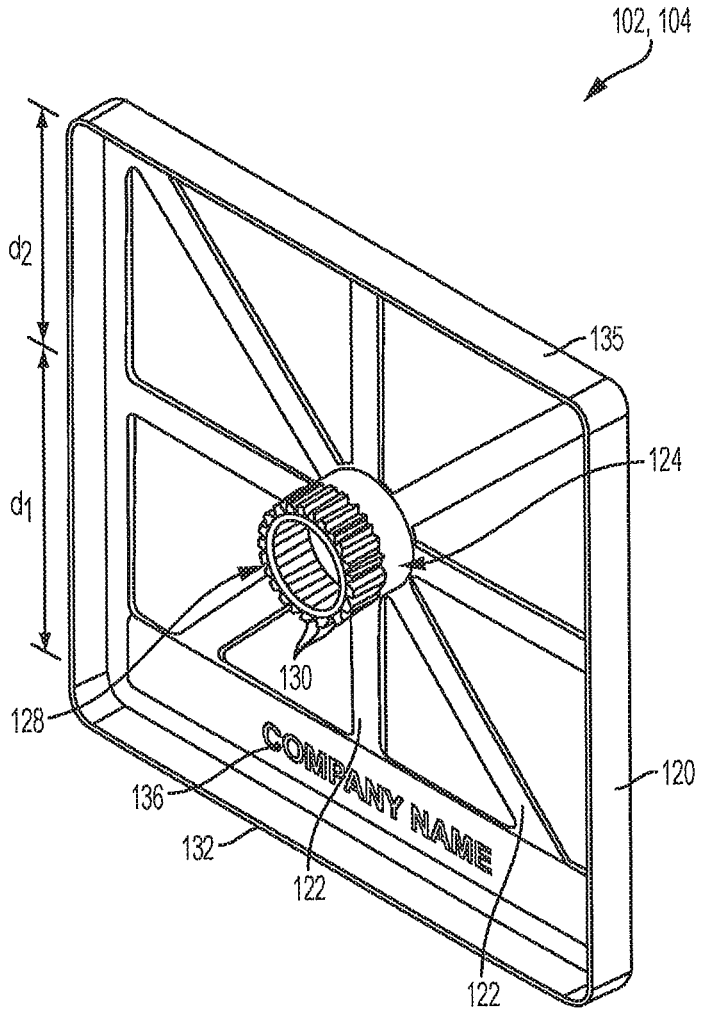
FIG. 2 is a perspective view of a support frame of the cable reel illustrated in FIG. 1.
Figure 3:
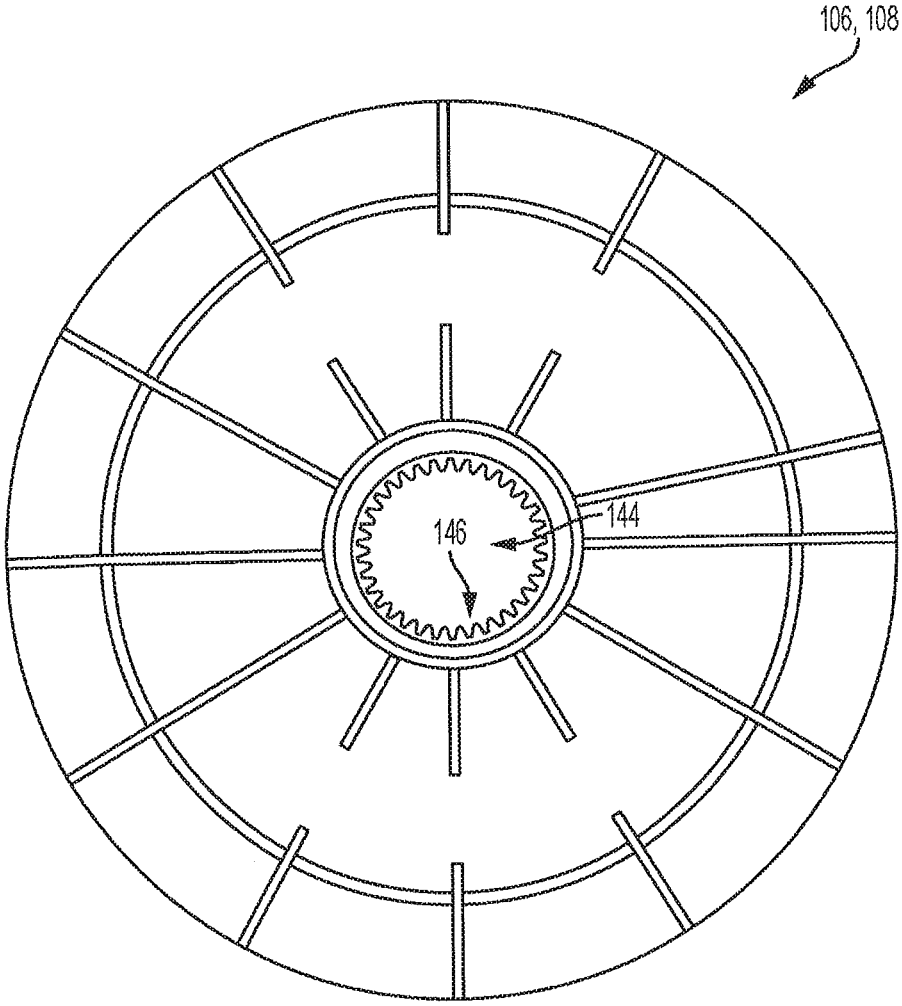
FIG. 3 is an elevational view of a flange of the cable reel illustrated in FIG. 1.
Figure 6:
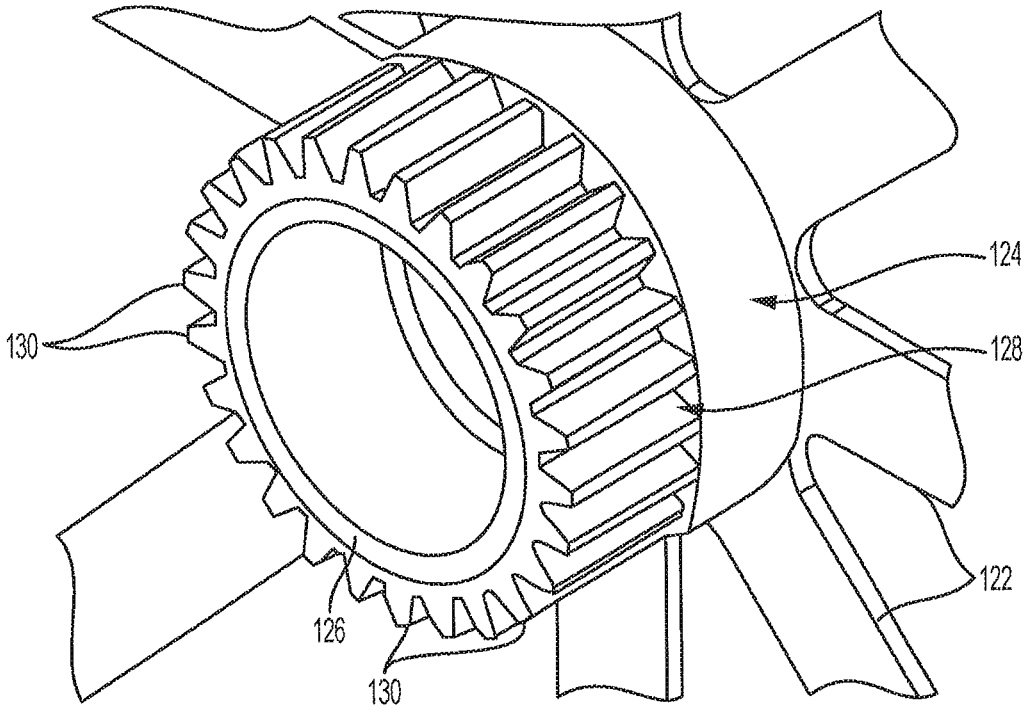
FIG. 6 is an enlarged partial perspective view of the frame illustrated in FIG. 2, showing outer gears of the frame.
Figure 7:
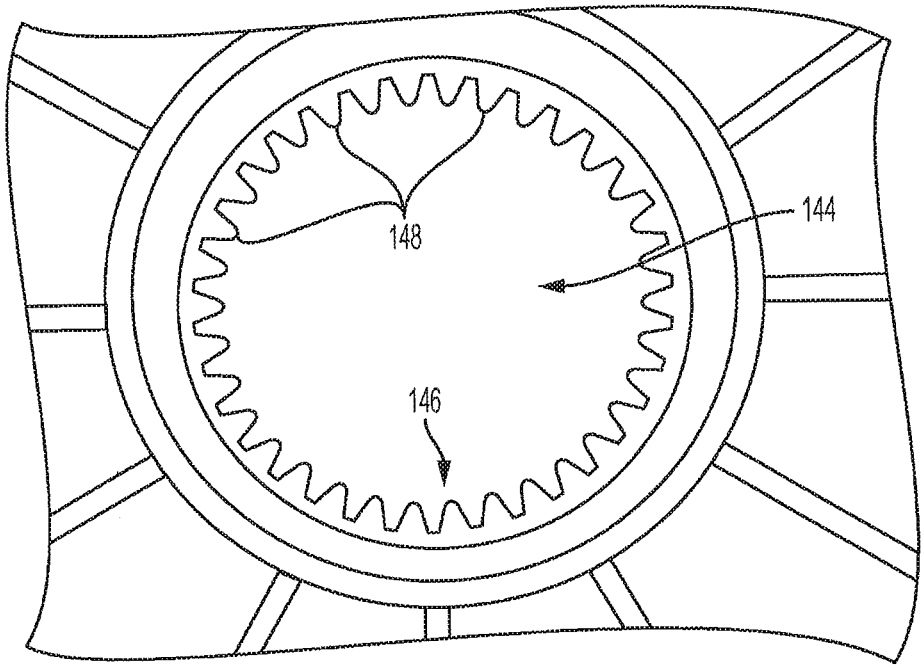
FIG. 7 is an enlarged partial side elevational view of the flange illustrated in FIG. 3, showing the inner gears of the flange.

As seen in FIGS. 2 and 6, each support frame 102 and 104 includes an outer frame portion 120 with one or more cross members 122 and a middle flange support 124. The outer frame portion 120 may have a substantially square geometry. The middle flange support 124 includes an annular extension 126 (FIG. 6) that supports a first part of the braking mechanism 112. The first part of the braking mechanism may be an outwardly extending gear member 128 that includes a plurality of annularly arranged teeth 130 extending radially outwardly from the annular extension 126.

Figure 8:
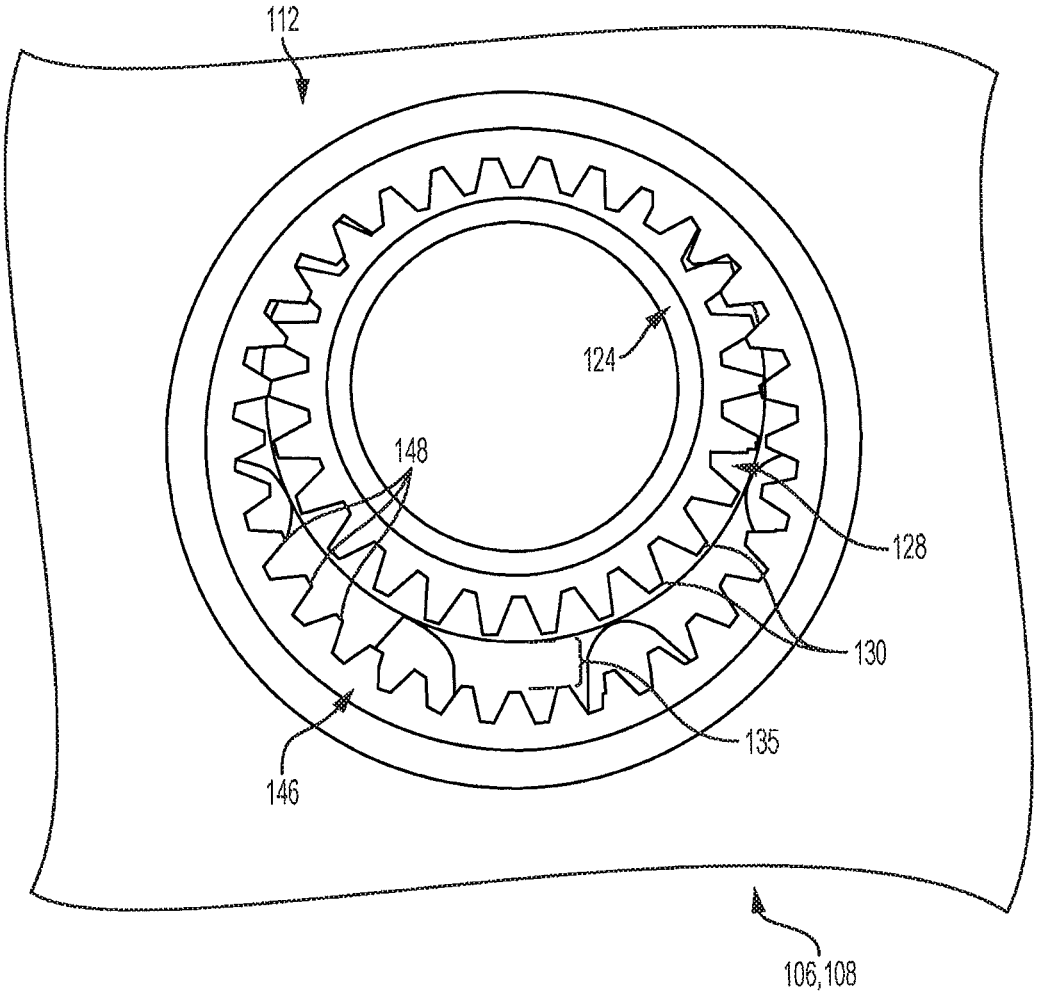
FIG. 8 is an enlarged side elevational view of the frame and the flange of the cable reel illustrated in FIG. 1, showing the inner and outer gears engaged.

The middle flange support 124 and gear member 128 are offset or off-center on the frame such that the distance $d_1$ (FIG. 2) to one end 132 of the frame is longer than the distance $d_2$ (FIG. 2) to the opposite end 135 of the frame. This offset provides a gap 134, as seen in FIG. 8, in the braking mechanism 112. Indicia 136, such as a company name, may be provided on the end 132 of the frame to indicate the longer side, that is distance $d_1$ of the frame to facilitate the orientation of the cable reel 100 in the bag or box.

Each flange 106 and 108 is preferably sized to fit within the outer frame portion 120 of its respective support frame 102 and 104 and is sized to accommodate the cable, such as a cable coil. The cable coil may be, for example, having an outer diameter of 345 mm and an inner diameter of 200 mm and a height of 135 mm. The flanges 106 and 108 are preferably disc-shaped. Each flange has inner and outer surfaces 140 and 142 and a central arbor opening 144. The inner surface 140 of each flange abuts the hub member 110 and the outer surface 142 abuts a respective support frame 102 and 104.

The central arbor opening 144 corresponds to the middle flange support 124 of each respective support frame. The central arbor opening 144 supports the second part of the braking mechanism 112 has seen in FIGS. 3 and 7. The second part of the braking mechanism 112 may be an internal gear member 146 that includes a plurality of annular arranged teeth 148 extending radially inwardly.

The hub member 110 is located between the flanges 106 and 108 and supports the cable coil. The hub member 110 includes a first hub portion 150 (FIGS. 4A and 4B) and a second hub portion 152 (FIGS. 5A and 5B) that are axially aligned and configured to mate with one another. The hub portions 150 and 152 may be formed separately from the respective flanges 106 and 108 and attached thereto or the hub portions 150 and 152 may be formed as one-piece with the respective flanges 106 and 108.

Figure 4A:
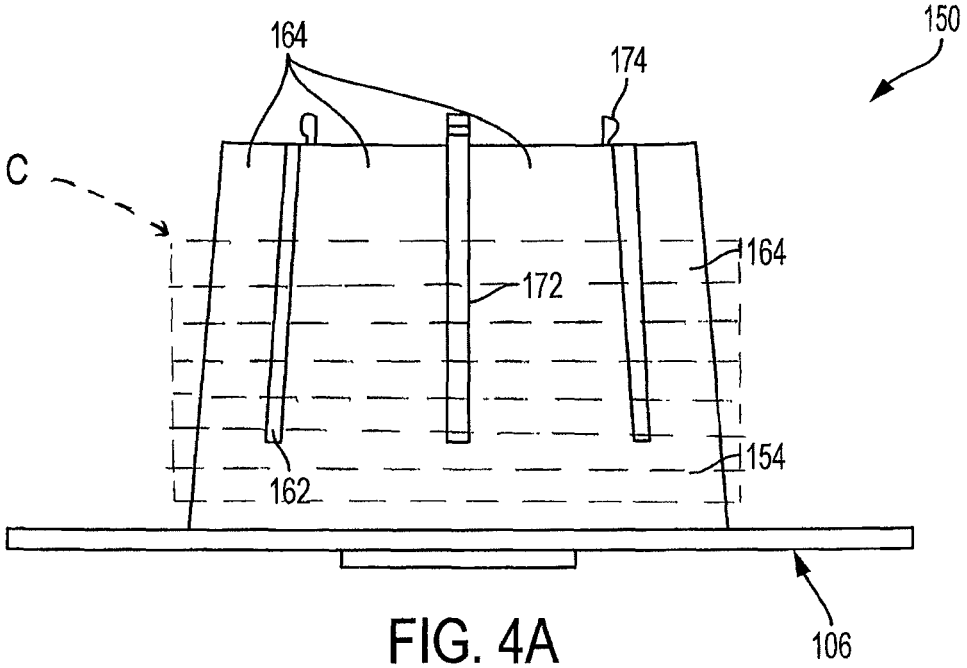
FIG. 4A is a perspective view of a first hub portion of the cable reel illustrated in FIG. 1.
Figure 4B:
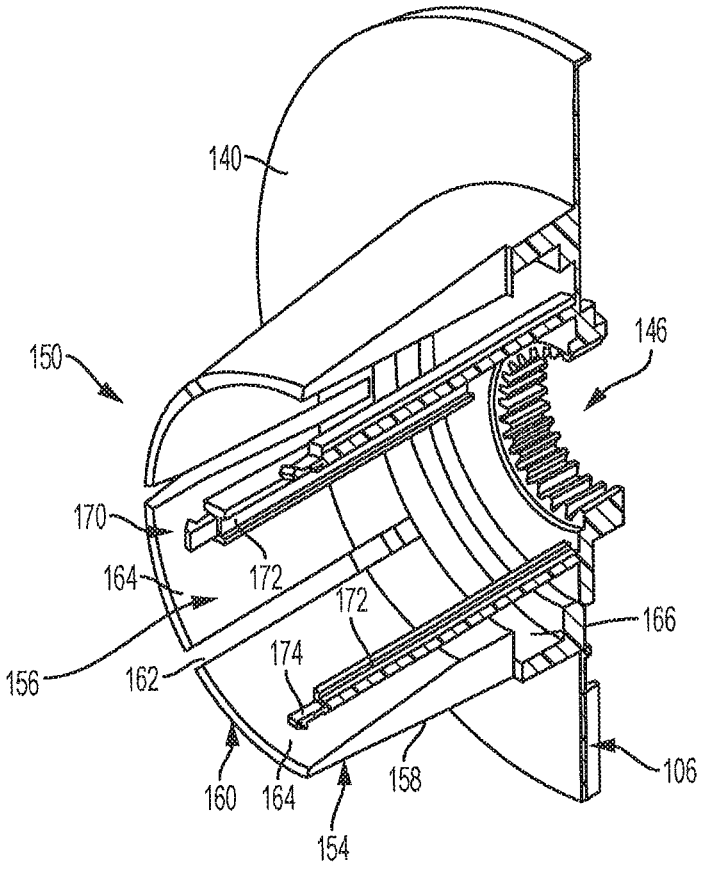
FIG. 4B is a partial perspective view of the first hub portion illustrated in FIG. 4A, showing the bottom hub in cross-section.

As seen in FIGS. 4A and 4B, the first hub portion 150 is preferably the base of the cable reel and provides the main support for the cable. As such, the first hub portion 150 is larger than the second hub portion 152. The first hub portion 150 includes an elongated wall 154 that extends from the inner surface 140 of the first flange 106 and defines an inner area 156 that receives the second hub portion 152. The elongated wall 154 has a tapered outer surface 158 that tapers inwardly from the flange inner surface 140 to the free end 160 of the wall 154. Slots 162 in the elongated wall 154 create flexible segments 164, which engage both the second hub portion 152 and the cable coil to retain the same. A groove 166 (FIG. 4B) may be located at the base of the elongated wall 154 to provide additional flexibility to the segments 164. Any other mechanism may be provided to add flexibility to the segments 164. For example, the segments 164 can be made thinner.

Secondary engagement members 170 may be provided as a back-up to retain the hub portions 150 and 152 together. The secondary engagement members 170 may be, for example, one or more snap arms 172 provided in the inner area 156 that extend from the flange inner surface 140. The one or more snap arms 172 preferably extend beyond the elongated wall 154 of the first hub portion 150, as seen in FIG. 4A, in order to engage the second flange 108. The ends of the snap arms 172 preferably include snap tabs 174 that engage corresponding slots 176 (FIG. 5B) in the second flange 108. Although a snapping engagement is preferred to secure the hub portions 150 and 152 together, any known interlocking mechanism may be used.

Figure 5A:
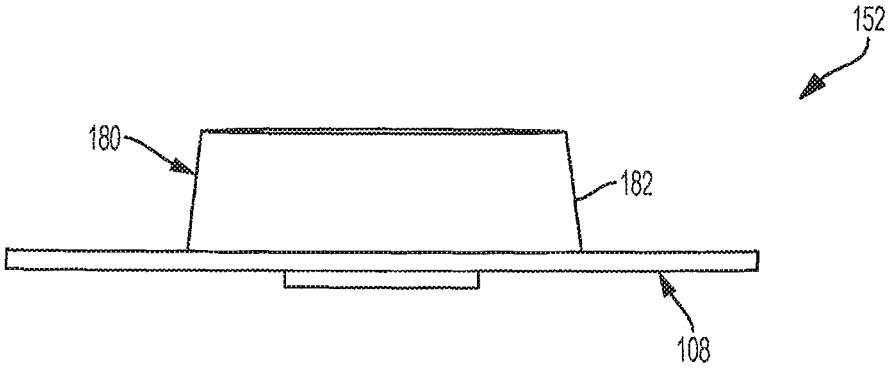
FIG. 5A is an elevational view of a second hub of the cable reel illustrated in FIG. 1.
Figure 5B:
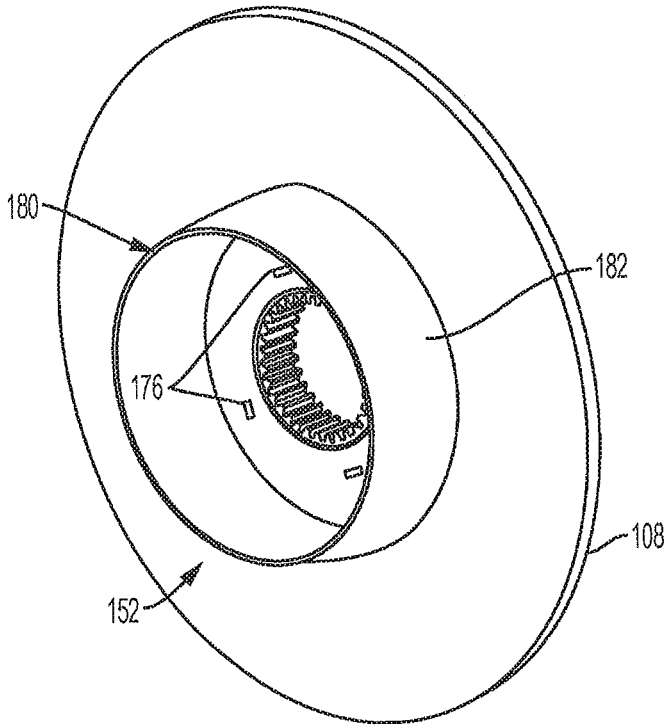
FIG. 5B is a perspective view of the second hub of the cable reel illustrated in FIG. 5A.

As seen in FIGS. 5A and 5B, the second hub portion 152 includes a truncated wall 180 that extends from the inner surface 140 of the second flange 108. The truncated wall 180 has a tapered outer surface 182 that fits inside of the elongated wall 154 of the first hub portion 150 to form a friction fit between the hub portions 150 and 152 and expands the flexible segments 164 of the first hub portion 150.

As seen in FIG. 8, the braking mechanism 112 is provided by meshing the teeth 130 and 148 of the outer and internal gear members 128 and 146. The gap 134 between the teeth 130 and 148 provides clearance for the teeth to slip or jump when the cable is pulled from the reel. The gear members 128 and 146 prevent overpayout of the cable. More specifically, when the cable is pulled from the reel, the flange 106 and 108 rotate, thereby making the gear teeth 148 rotate. The side support 120 is preferably fixed inside of the supporting bag or box and therefore does not rotate. This causes the gear teeth 148 to override meshing gear teeth 130 on the side support 128 which creates friction and provides a braking to the momentum of reel if the cable is pulled too hard. This action also creates a clicking mechanism which in turn prevents overpaying the cable.

The distance of the gap need only be long enough to provide a clearance to have gear teeth 148 to override teeth 130, thereby allowing the braking mechanism to work. This clearance distance could vary depending upon the gear teeth depth, flange hole inner diameter, side support gear depth, and the outer diameter of the middle flange support 124. The gap 134 may be, for example, about ¼ inch.

To install the cable on the cable reel 100, the cable coil C is placed over the first hub portion 150 of the hub member 110 and on the first flange 106 so that the first hub portion 150 extends through the inner diameter of the cable coil. The cable coil C may be prepacked in a plastic shrink wrap or with tie wraps or combination of both without any external structure to support that coil. Next the second hub portion 152 is inserted inside of the first hub portion 150 to frictionally engage the same and expand the flexible segments 164, thereby forcing the flexible segments 164 to engage the inner diameter of the cable coil. The locking tabs 174 are then inserted inside of the slots 176 on the second flange 108 to hold two flanges and hub portions together.

In an example of the present disclosure, the first support frame 102 of the reel 100 is secured to the base of the bag or box, such as by straps, such as via strap 105 (FIG. 1), and the second support frame 104 is secured to the cover or flap of the bag. With the cable coil installed on the hub member 110, the cable coil is inserted into the bag or box between the support frames 102 and 104 in the bag or box. The assembly of the hub portions 150 and 152, the flanges 106 and 108, and the cable coil is preferably inserted into the base of the bag on its side such that the middle flange support 124 of the frame secured to the base of the bag fits inside of the central arbor opening 144 of the flange. Similarly, the middle flange support 124 of the frame secured to the cover of the bag fits inside of the opening 144 of the other flange when the bag is closed. Once the frames 102 and 104 are mated with the flanges 106 and 108, respectively, the operator can then dispense or payout the cable through a cable payout slot or opening in the bag or box. The operator may open the cover of the bag or box to separate the hub portions 150 and 152 by disengaging the snap tabs 174.

FIGS. 9-17 illustrate another example of a cable reel 200 of the present disclosure. The cable reel 200 is configured to be carried in a conventional shoulder bag or satchel, a cardboard or plastic box, and the like 210, similar to the cable reel 100. The bag 210 can have a payout opening or slot 212 for easy payout of cable of the coil of cable C supported on the cable reel 200 that is inside of the bag 210. Like the cable reel 100, the cable reel 200 is separable and designed to provide easy installation, distribution, and replacement of the coil of cable C on the reel 200 without having to discard the cable reel 200. As such, the cable reel 200 is reusable for supporting the coil of cable C and any number of replacement cable coils once the cable of the coil of cable C is distributed, such as by the installer. Because the cable reel 200 is designed to be carried by an installer, the components of the cable reel 200 may be formed of lighter weight materials, such as plastic, like cable reel 100.

The cable reel 200 (FIG. 16) may comprise a one-piece frame body 220 (FIG. 13), a flange 222 (FIG. 14) separate from the one-piece frame body 220, and a hub member 224 (FIGS. 15*a* and 15*b*) located between the one-piece frame body 220 and the flange 22 along a central longitudinal axis L (FIGS. 12*a* and 12*b*) of the cable reel 200. In an example, the present disclosure provides a cable reel apparatus 300 that may comprise the coil of cable C, the bag 210, and the cable reel 200. The bag 210 has a base 214 sized to hold the cable reel 200 and the coil of cable C, and a cover 216 that opens and closes with respect to the base 214. The bag 210 may also include a handle or strap 218 on one or more sides of the bag 210. The payout opening 212 can be located in the base 214. In another example, the present disclosure provides a kit of separate components for assembly of the cable reel apparatus 300. The kit may comprise the bag 210, the one-piece frame body 220, the flange 222, and the hub member 224.

The cable reel 200 is designed such that the flange 222 and the hub member 224 rotate together with respect to the one-piece frame body 220 when distributing the cable. That is the flange 222 and the hub member 224 rotated together as one while the one-piece frame body 220 remains stationary.

Figure 11:
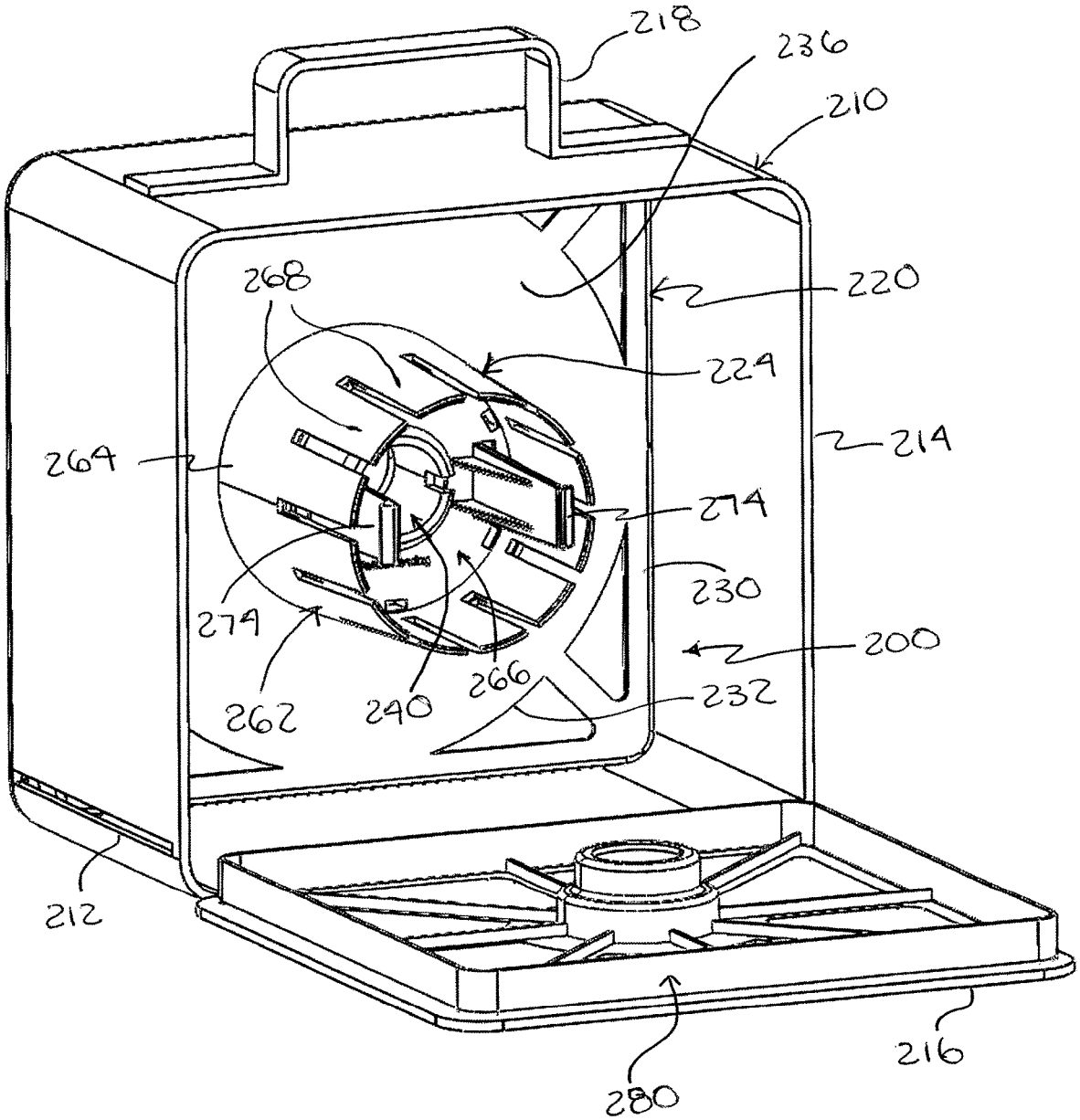
FIG. 11 is a perspective view similar to FIG. 10 with the coil of cable removed for clarity.
Figure 12A:
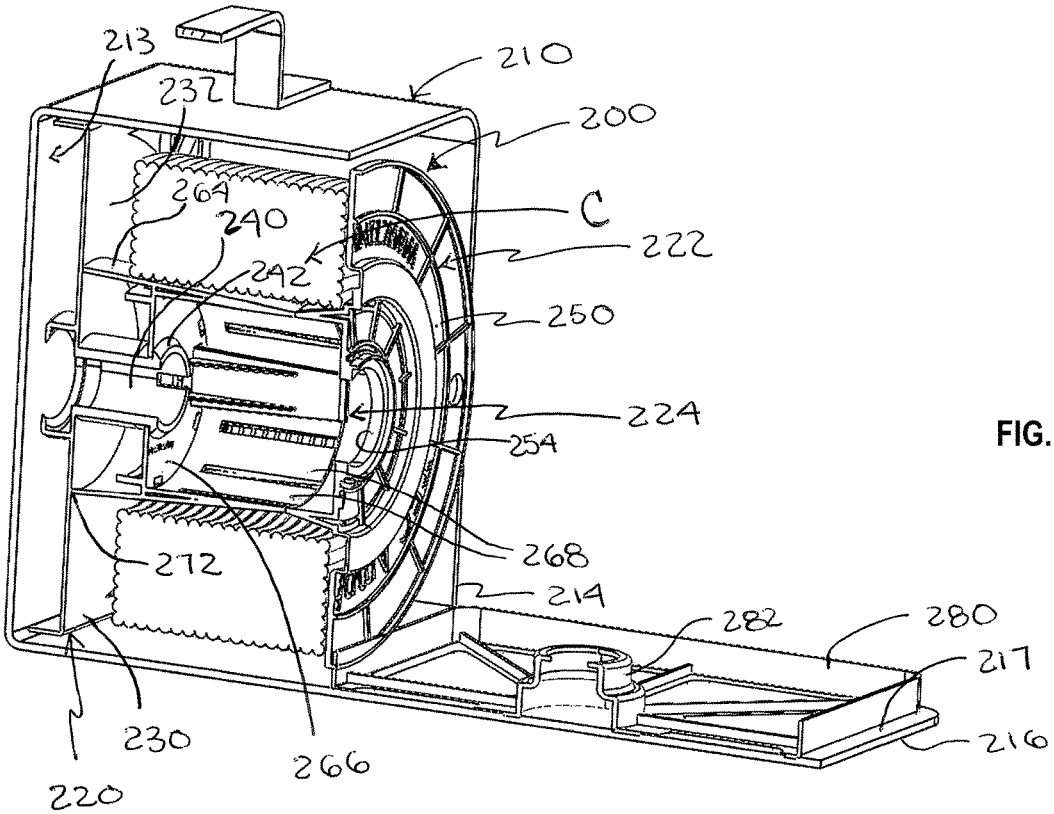
FIGS. 12*a* and 12*b* are perspective and elevational views of a cross-section of the cable reel illustrated in FIG. 9.
Figure 12B:
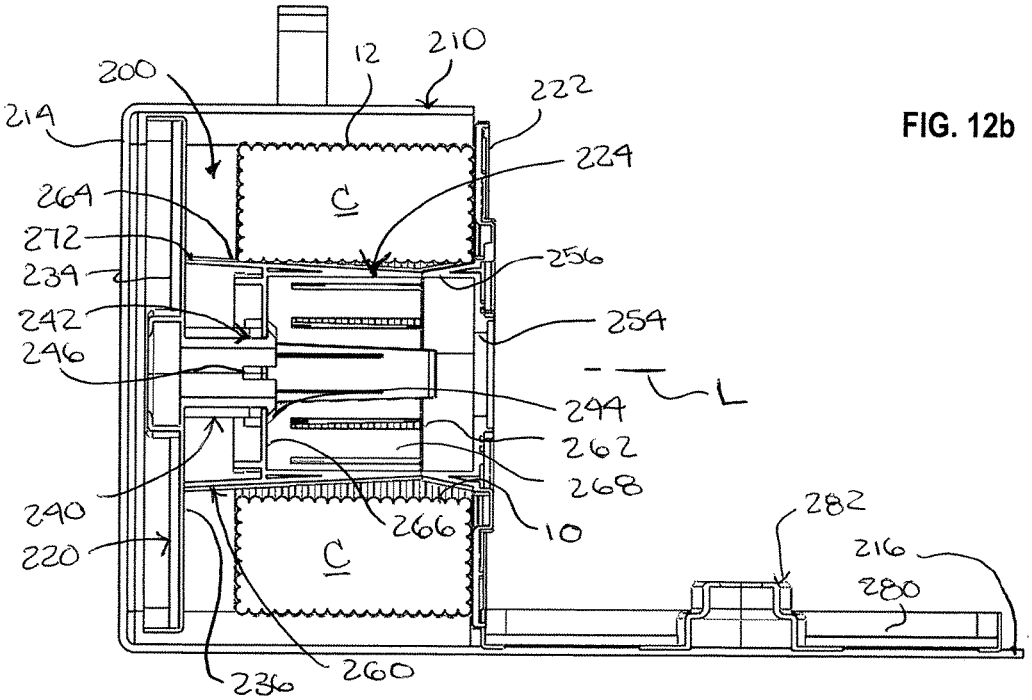
Figure 13:
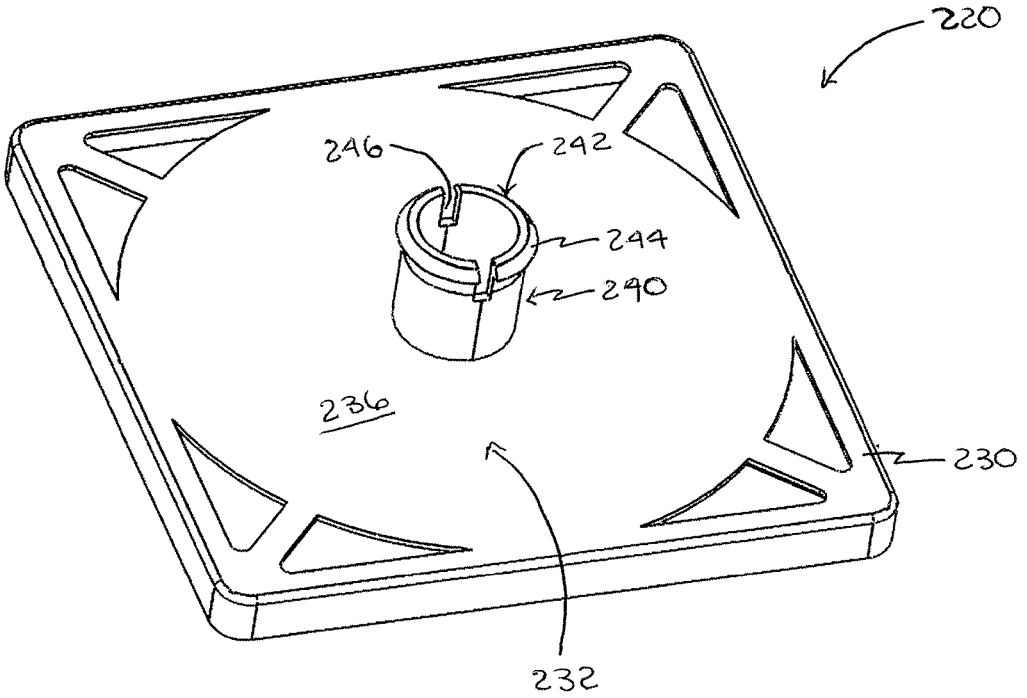
FIG. 13 is a perspective view of a frame body of the cable reel illustrated in FIG. 9.
Figure 14:
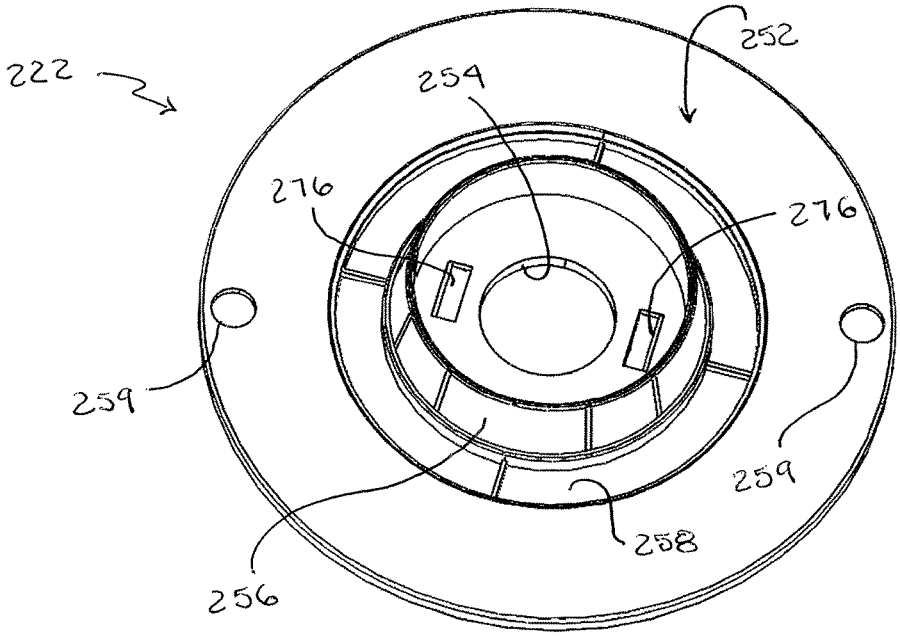
FIG. 14 is a perspective view of a flange of the cable reel illustrated in FIG. 9.

The frame body 220 is a one-piece, unitary, integral body that includes an outer frame portion 230 and an inner flange portion 232, as seen in FIGS. 11-13. The flange 222 and/or the hub member 224 can also be one-piece. The one-piece frame body 220 is configured to be received inside of the base 214 of the bag 210. The outer frame portion 230 has a geometry for placement on an inside surface 213 (FIG. 12*a*) of the base 214 of the bag 210. The outer frame portion 230 surrounds the inner flange portion 232. The outer frame portion 230 may have a substantially square shape and the inner flange portion 232 may have a substantially disc shape.

The inner flange portion 232 has an outer side 234 and an inner side 236. The inner flange portion 232 has a coupler 240 for releasably and rotatably engaging the hub member 224. The coupler 240 extends from the center of the inner side 236 of the inner frame portion 232 for rotatably coupling to a first end 260 of the hub member 224. The coupler 240 has a flexible distal end 242 for snapping into a transverse wall 266 of the hub member, as best seen in FIGS. 12*a* and 12*b*. In an example, the flexible distal end 242 can include a lip 244 to facilitate snapping into the transverse wall 266 of the hub member 224. Also, one or more slots 246 can be provided at the distal end 242 to provide flexibility to the distal end 242, thereby allowing the distal end to flex inwardly and outwardly for a snapping engagement with the hub member 224.

Figure 9:
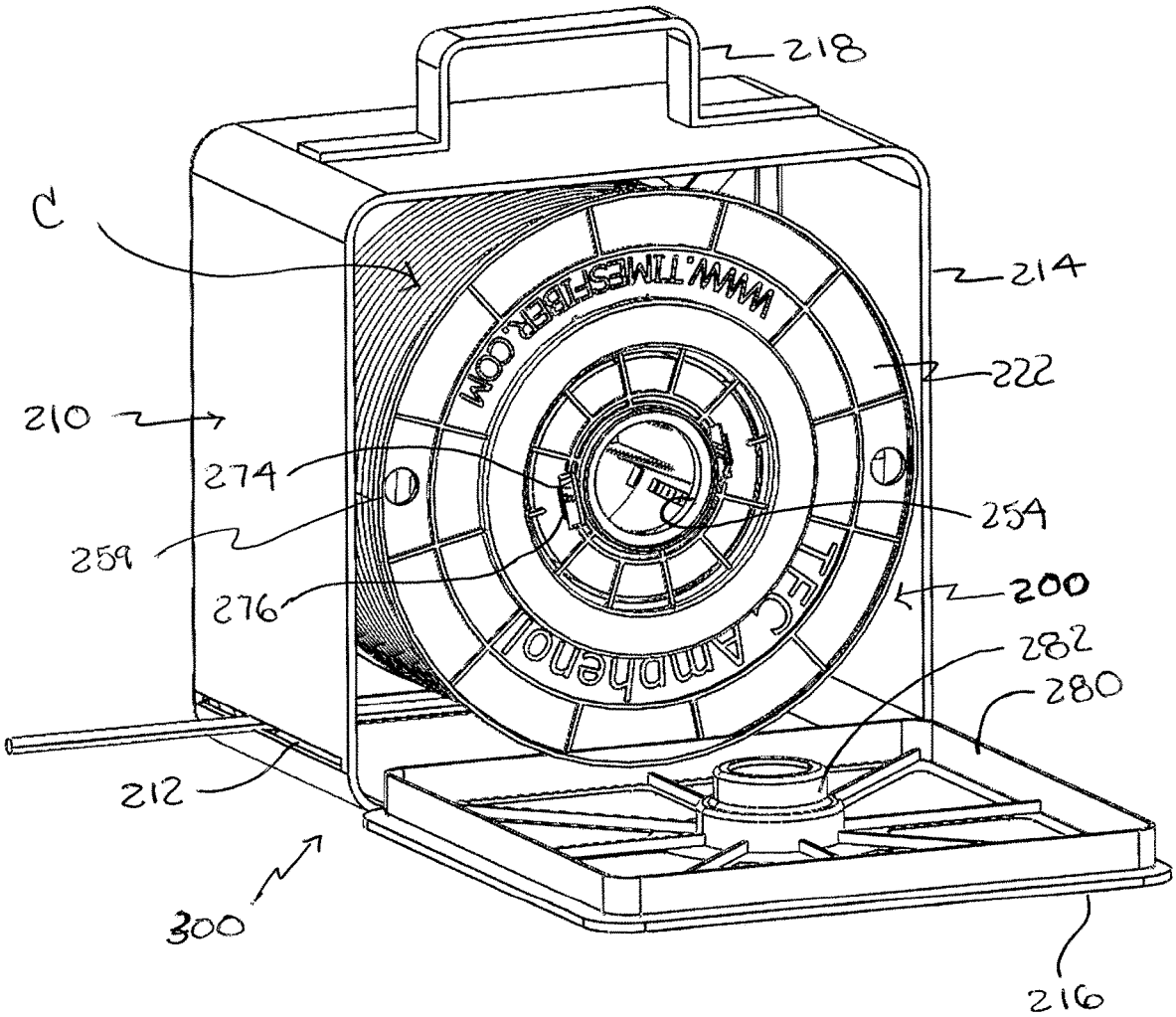
FIG. 9 is a perspective view of a cable reel in accordance with another example of the present disclosure, showing the cable reel within a bag and supporting a coil of cable.

The flange 222 is sized to accommodate and retain an outer diameter 12 of the coil of cable C, as seen in FIG. 9. The flange 222 has an outer side 250 and an inner side 252. The inner side 252 of the flange 222 faces the inner side 236 of the one-piece frame body 220 so that the flange 22 is positioned facing the one-piece frame body 220. The flange 222 has a central opening 254. The central opening 254 can be surrounded by a wall 256. The wall 256 may be a truncated. A channel 258 may be provided in the flange 222 that surrounds the truncated wall 256. One or more holes 259 can be provided at the periphery of the flange 222 for management of the cable of the coil of cable C.

Figure 15A:
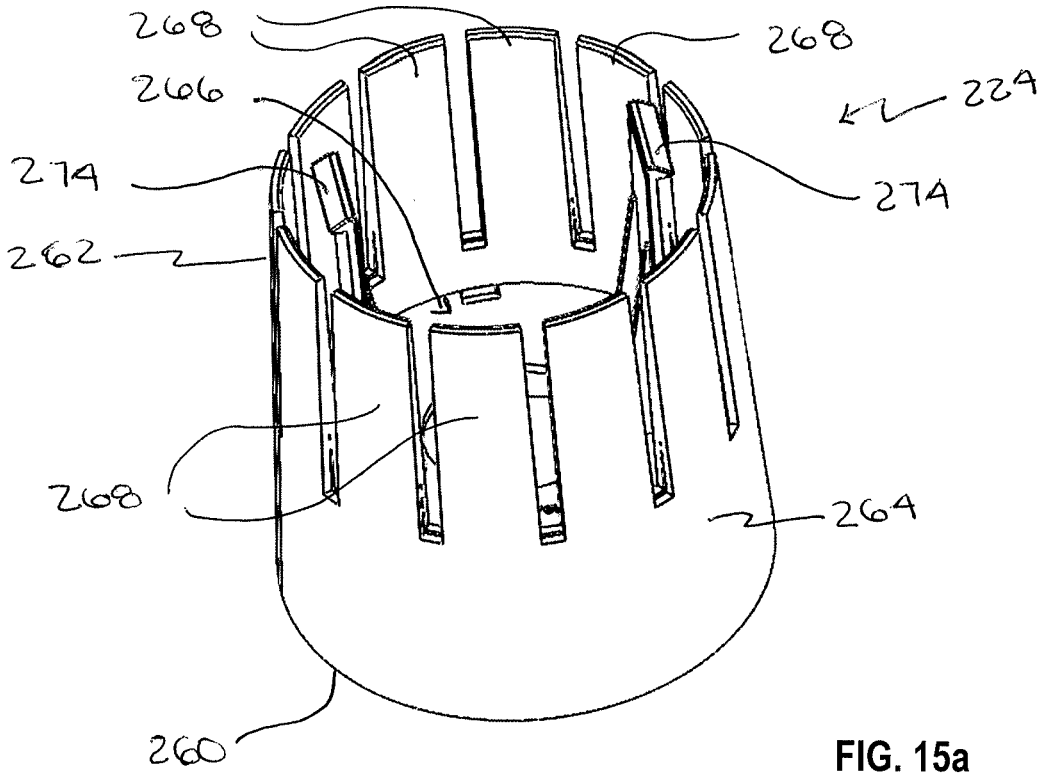
FIGS. 15*a* and 15*b* are opposite end perspective views of a hub member of the cable reel illustrated in FIG. 9.
Figure 15B:
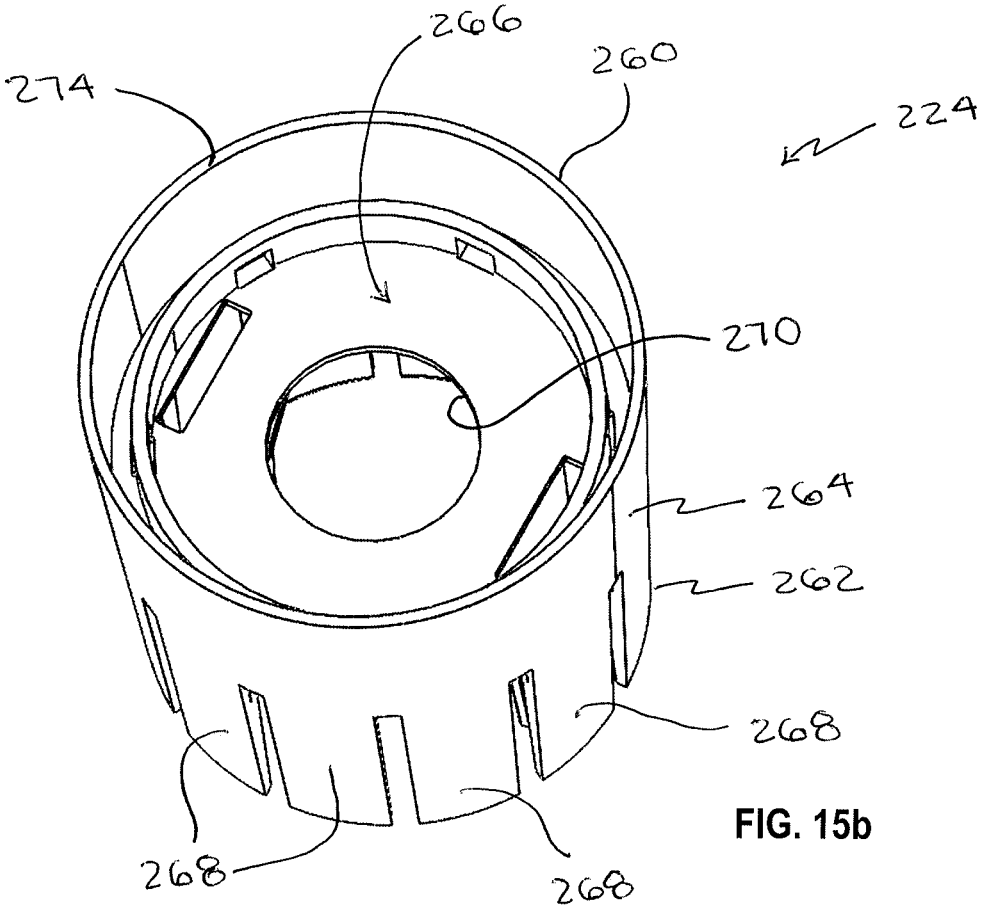
Figure 16:
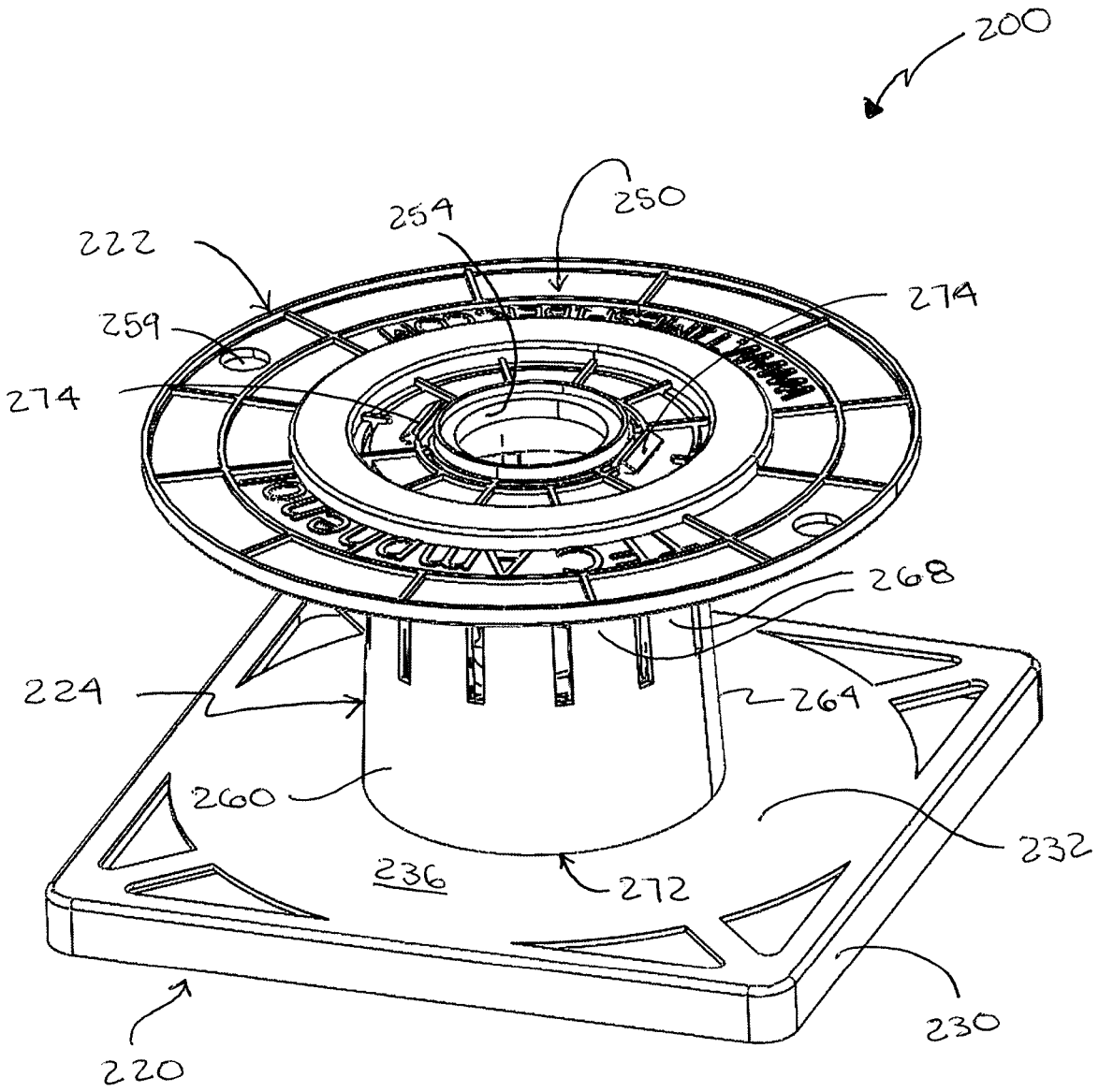
FIG. 16 is a perspective view of the cable reel illustrated in FIG. 9, showing the cable reel without the bag and coil of cable.

The hub member 224 has a first end 260 and a second end 262, as seen in FIGS. 15*a* and 15*b*. The first end 260 is configured to releasably and rotatably couple to the inner flange portion 232 of the one-piece frame body 220 and the second end 262 is configured to releasably and non-rotatably couple to the flange 222. The hub member 224 is configured to support the coil of cable C and is sized to be, at least partially, received inside of the inner diameter 10 of the coil of cable C, as seen in FIGS. 12*a* and 12*b*. The first end 260 of the hub member 224 is configured to releasably and rotatably couple to the coupler 240 of the one-piece frame body 220.

Figure 10:
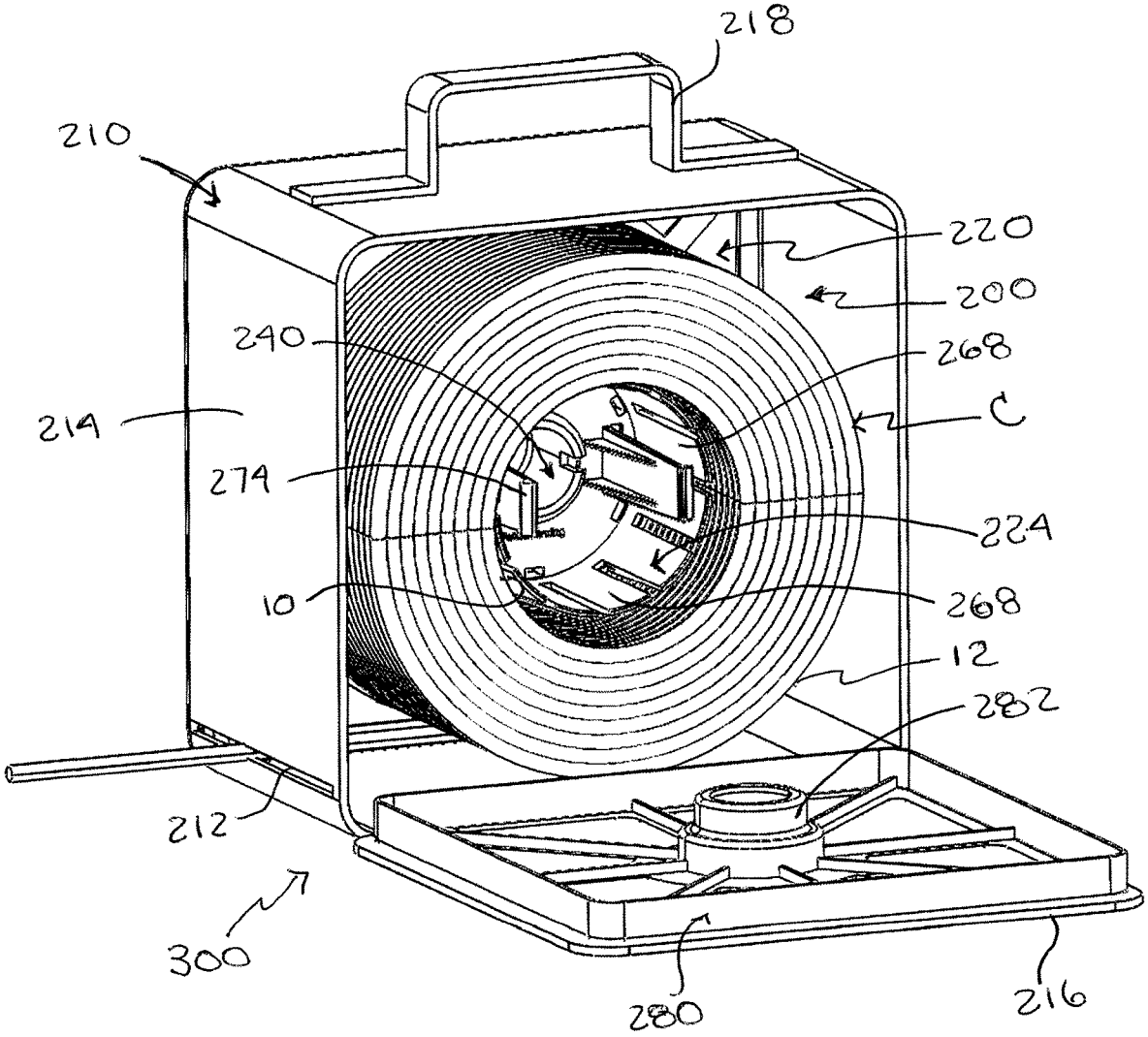
FIG. 10 is a perspective view of the cable reel illustrated in FIG. 9 with a flange of the cable reel removed for clarity.

The hub member 224 includes a main wall 264 and a transverse wall 266 therein. The transverse wall 266 is located generally at the first end 260 of the hub member 224. The main wall 264 is sized to fit at least partially within the inner diameter 10 of the coil of cable C. The main wall 264 includes one or more engagement features 268 for frictionally engaging the inner diameter 10 of the coil of cable C, as seen in FIG. 10. The one or more engagement features 268 can be, for example, one or more flexible tabs disposed in the main wall 264 of the hub member 224 that engage the inner diameter 10 of the coil of cable C.

The transverse wall 266 of the hub member 224 can have a central opening 270 that is sized to rotatably engage the coupler 240 of the one-piece frame body 220. To releasably and rotatably couple the hub member 224 with the one-piece body frame 220, the flexible distal end 242 of the coupler 240 is inserted into the first end 260 of the hub member 224 and pushed through the central opening 270 (FIG. 15*b*) of the transverse wall 266 until the lip 224 of the coupler 240 snaps in behind the transverse wall 266. This allows the hub member 224 to rotate with respect to the one-piece frame body 220 without separating from the one-piece frame body 220. When coupled, the end face 272 of the first end 260 of the hub member 224 can be adjacent and/or abut to the inner side 236 of the one-piece frame body 220 such that no structure is needed or located between the one-piece frame body 220 and the first end 260 of the hub member 224, as seen in FIGS. 12*a* and 12*b*. If desired, the distal end 242 of the coupler 240 can be flexed inwardly to disengage the coupler 240 from the transverse wall 266 of the hub member 224.

Figure 17:
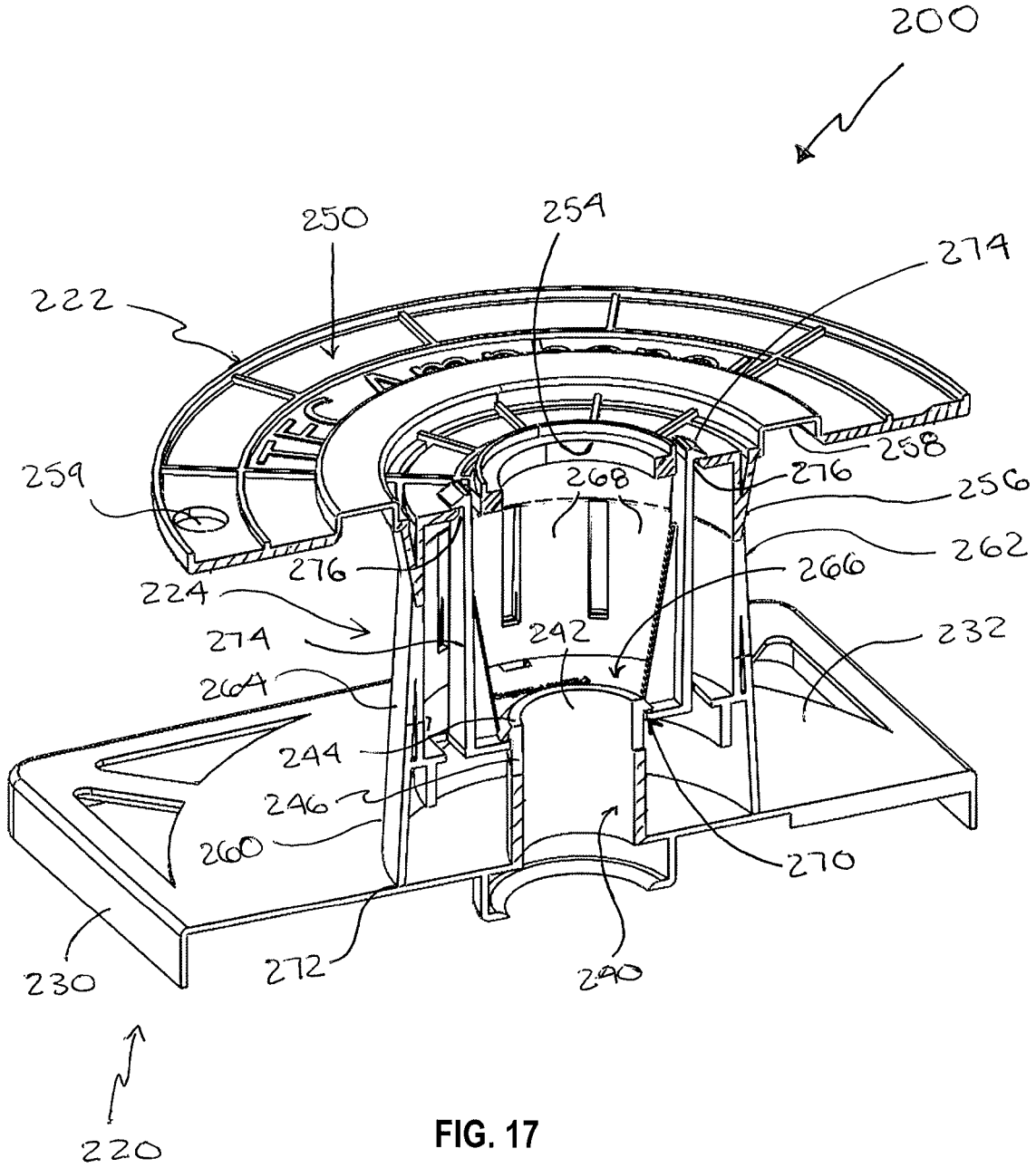
FIG. 17 is a sectional view of the cable reel illustrated in FIG. 16.

The hub member 224 also has one or more latching features 274 configured to releasably latch to the flange 222. The one or more latching features 274 can be one or more elongated snapping arms, as seen in FIGS. 15*a* and 17. The latching/snapping arms 274 can extend from the transverse wall 266 of the hub member 224 in a direction toward the second end 262 of the hub member 224. The latching/snapping arms 274 are configured to engage corresponding latching features 276 (FIG. 14), for example one or more slots, of the flange 222. To releasably but non-rotatably couple the hub member 224 to the flange 222, the latching/snapping arms 274 of the hub member 224 snap into the latching slots 276 of the flange 222. When coupled, the truncated wall 256 of the flange 222 can meet or abut the ends of the flexible tabs 268 of the hub member 224, as seen in FIG. 17. The latching/snapping arms 274 can be manipulated to unsnap/release from the flange 222 to disengage the hub member 224 from the flange 222, if desired.

In an example, the present disclosure provides a method or system for installing the coil of cable C on the cable reel 200 and reusing the cable reel 200 for replacement cable coils. To install the coil of cable C on the cable reel 200, the hub member 224 is coupled to the one-piece frame body 220 via the coupler 240 and the coil of cable C is placed over the hub member 224, as seen in FIGS. 10 and 11, so that the flexible tabs 268 of the hub member 224 extends into the inner diameter 10 of the coil of cable C. The hub member 224 is now frictionally engaging the coil of cable C. The coil of cable C may be reel-less and prepacked, such as in a plastic shrink wrap or with tie wraps or combination of both, without any external or internal structure to support that coil of cable.

Next, the flange 222 is coupled to the second end 262 of the hub member 220 to capture the coil of cable between the frame 222 and the one-piece frame body 220. The truncated wall 256 of the flange 222 is inserted toward the second end 262 of the hub member 224 until the elongated latching arms 274 snap into the corresponding latching slots 276 in the transverse wall 266 of the hub member 224, as seen in FIGS. 9, 12*a*, and 12*b*. The one-piece body frame 220 and the flange 222 are sized to be larger than the outer diameter 12 of the coil of cable C to accommodate the coil of cable C and retain the same on the cable reel 200.

In an example of the present disclosure, the one-piece frame body 220 of the cable reel 200, with the hub member 224 rotatably coupled thereto, is placed in the base 214 of the bag 210. The one-piece frame body 220 can be secured to the inner surface 213 of the base 214 of the bag 210, such as by straps or the like. A separate support frame 280 can be provided at the cover 216 of the bag 210, as seen in FIGS. 9-11. The support frame 280 can be secured to an inner surface 217 (FIG. 12*a*) of the cover 216, such as by straps or the like.

With the coil of cable C installed on cable reel 200, the operator can close the cover 216 of the bag 210 onto the base 214 such that a center support 282 of the support frame 280 engages or is inserted into the central opening 254 of the flange 222 of the cable reel 200. The operator can then dispense the cable of the coil of cable C through the payout opening 212 in the bag 210, as seen in FIG. 9. The bag 210 is positioned that the central longitudinal axis L of the cable reel 200 is horizontal, as seen in FIGS. 9, 10, and 12*b*, to facilitate dispensing of the cable through the payout opening 212 in the bag 210.

Once the cable has been dispensed, a replacement coil of cable can be installed onto the same cable reel 200. To do so, the cover 216 of the bag 210 is opened so that the center support 282 is of the support frame 280 is removed from the central opening 254 of the flange 222 of the cable reel 200. The flange 222 can then be disengaged from the hub member 224 but pressing and unsnapping the elongated latching arms 274 from the flange 222. The replacement coil of cable C can then installed on the hub member 224 and the flange 22 coupled with the second end 262 of the hub member 224 to reassembly the cable reel 200. The cover 216 of the bag 210 is again closed for dispensing the cable of the replacement coil of cable C through the payout opening 212 of the bag.

It will be apparent to those skilled in the art having the benefit of the teachings presented in the foregoing descriptions and the associated drawings that modifications, combinations, sub-combinations, and variations can be made without departing from the spirit or scope of this disclosure. For example, the flange 222 of the cable reel can be eliminated or integrated into the support frame 280 similar to the one-piece frame 220. In this example, the cable reel system includes (a) the bag, (b) the two one-piece frames and (c) the coil of cable. One or both of the one-piece frames could include a hub member (similar to 224) to support the coil of cable. In another example, the frames could also include rotating "flanges" that are part of the frame rather than being a separate element. In each frame, the hub member and flange could be unitary and rotatable to allow the cable coil to rotate more easily in the bag.

Likewise, the various examples described may be used individually or in combination with other examples. Those skilled in the art will appreciate various combinations of examples not specifically described or illustrated herein that are still within the scope of this disclosure. In this respect, it is to be understood that the disclosure is not limited to the specific examples set forth and the examples of the disclosure are intended to be illustrative, not limiting.

As used in this specification and the appended claims, the singular forms "a", "an" and "the" include plural referents, unless the context clearly dictates otherwise. Similarly, the adjective "another," when used to introduce an element, is intended to mean one or more elements. The terms "comprising," "including," "having" and similar terms are intended to be inclusive such that there may be additional elements other than the listed elements.

Additionally, where a method described above or a method claim below does not explicitly require an order to be followed by its steps or an order is otherwise not required based on the description or claim language, it is not intended that any particular order be inferred. Likewise, where a method claim below does not explicitly recite a step mentioned in the description above, it should not be assumed that the step is required by the claim.

It is noted that the description and claims may use geometric or relational terms, such as right, left, above, below, upper, lower, top, bottom, linear, arcuate, elongated, parallel, perpendicular, etc. These terms are not intended to limit the disclosure and, in general, are used for convenience to facilitate the description based on the examples shown in the figures. In addition, the geometric or relational terms may not be exact. For instance, walls may not be exactly perpendicular or parallel to one another because of, for example, roughness of surfaces, tolerances allowed in manufacturing, etc., but may still be considered to be perpendicular or parallel.

What is claimed is:

1. A cable reel, comprising:

a one-piece frame body, the one-piece frame body including an outer frame portion and an inner flange portion, the inner flange portion having an outer side and an inner side;

a flange separate from the one-piece frame body, the flange having an outer side and an inner side, the inner side of the flange facing the inner side of the one-piece frame body; and a hub member located between the one-piece frame body and the flange along a central longitudinal axis of the cable reel, the hub member having a first end and a second end, the first end rotatably couples to the inner flange portion of the one-piece frame body and the second end couples to the flange, the hub member being configured to support a coil of cable and is sized to be received inside of an inner diameter of the coil of cable;

wherein the flange and the hub member rotate together with respect to the one-piece frame body.

2. The cable reel of claim 1, wherein the one-piece frame body has a coupler extending from the inner frame portion for rotatably coupling to the first end of the hub member.

3. The cable reel of claim 2, wherein the coupler has a flexible distal end for snapping into a transverse wall of the hub member.

4. The cable reel of claim 1, wherein the hub member has one or more engagement features configured to frictionally engage the inner diameter of the coil of cable.

5. The cable reel of claim 4, wherein the one or more engagement features is one or more flexible tabs disposed in a main wall of the hub member.

6. The cable reel of claim 1, wherein the hub member has one or more latching features configured to releasably latch to the flange.

7. The cable reel of claim 6, wherein the one or more latching features is one or more elongated snapping arms.

8. The cable reel of claim 1, wherein the hub member is one-piece or the flange is one-piece.

9. The cable reel of claim 1, wherein the outer frame portion of the one-piece frame body surrounds the inner flange portion.

10. The cable reel of claim 9, wherein the outer frame portion has a substantially square shape and the inner flange portion has a substantially disc shape.

11. The cable reel of claim 1, wherein an end face of the first end of the hub member is adjacent to the inner side of the one-piece frame body.

12. The cable reel of claim 1, wherein the flange has a central opening for rotational engagement with a frame.

13. A cable reel apparatus, comprising:

a coil of cable, the coil of cable having an outer diameter and an inner diameter;

a bag having a base, a cover, and a payout opening for dispensing cable of the coil of cable; and a cable reel, comprising, a one-piece frame body configured to be received inside of the base of the bag, the one-piece frame body having an outer frame portion and an inner flange portion, a flange separate from the one-piece frame body that is configured to be positioned facing the one-piece frame body, the flange being sized to accommodate the outer diameter of the coil of cable; and a hub member located between the one-piece frame body and the flange along a central longitudinal axis of the cable reel, the hub member having a first end and a second end, the first end releasably and rotatable couples to the inner flange portion of the one-piece frame body and the second end releasably and non-rotatably couples to the flange, the hub member being configured to support the coil of cable and is sized to be received inside of the inner diameter of the coil of cable, wherein the flange and the hub member rotate together with respect to the one-piece frame body.

14. The cable reel apparatus of claim 13, wherein the coil of cable is prepackaged without a reel.

15. The cable reel apparatus of claim 13, wherein the hub member includes a main wall and a transverse wall therein, the main wall being sized to fit within the inner diameter of the coil of cable.

16. The cable reel apparatus of claim 15, wherein the main wall includes one or more engagement features for frictionally engaging the inner diameter of the coil of cable.

17. The cable reel apparatus of claim 15, wherein the transverse wall includes an opening for rotatably coupling with a coupler of the one-piece frame body, the coupler extending from the inner flange portion of the one-piece frame body.

18. The cable reel apparatus of claim 13, wherein the hub member includes one or more latching features for releasably and non-rotatably coupling to the flange.

19. The cable reel apparatus of claim 13, wherein there is no structure between the first end of the hub member and the inner side of the one-piece frame body.

20. The cable reel apparatus of claim 13, wherein the flange includes an opening configured to rotatably couple with a frame on an inside surface of the cover of the bag.

21. A kit of separate components for assembly of a cable reel apparatus, comprising:

a bag having a base and a cover, wherein the bag is sized to hold a coil of cable;

a one-piece frame body that includes an outer frame portion and an inner flange portion, the outer frame portion having a geometry for placement on an inside surface of the base of the bag and the inner flange portion having a coupler;

a flange sized to accommodate an outer diameter of the coil of cable; and a hub member that has a first end and a second end, the first end of the hub member is configured to releasably and rotatably couple to the coupler of the one-piece frame body, and the second end of the hub member is configured to releasably and non-rotatably couple with the flange.

22. The kit of claim 21, wherein the outer frame portion of the one-piece frame body has a substantially square shape that surrounds the inner flange portion, the inner flange portion has a substantially disc shape, and the coupler extends from a center of the inner flange portion.

23. The kit of claim 21, wherein the hub member includes a main wall and a transverse wall therein, the main wall has one or more flexible tabs at the second end, and the transverse wall has an opening sized to rotatably couple with the coupler of the one-piece frame body.

24. The kit of claim 21, wherein the hub member includes one or more elongated latching arms configured to releasably and non-rotatably engage the flange.

25. The kit of claim 24, wherein the flange has a substantially disc shape and a central opening for engaging the frame of the cover.

26. The kit of claim 21, wherein the cover of the bag includes a frame on an inside surface thereof, the flange of the cable reel is configured to rotatably coupling with the frame of the cover.

* * * * *